US009822994B2

(12) United States Patent
Yanachi et al.

(10) Patent No.: US 9,822,994 B2
(45) Date of Patent: Nov. 21, 2017

(54) REFRIGERATION CYCLE SYSTEM WITH INTERNAL HEAT EXCHANGER

(71) Applicant: Mitsubishi Electric Corporation, Tokyo (JP)

(72) Inventors: Satoru Yanachi, Tokyo (JP); Yohei Kato, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 498 days.

(21) Appl. No.: 14/390,869

(22) PCT Filed: Apr. 19, 2013

(86) PCT No.: PCT/JP2013/061680

§ 371 (c)(1),
(2) Date: Oct. 6, 2014

(87) PCT Pub. No.: WO2013/161725

PCT Pub. Date: Oct. 31, 2013

(65) Prior Publication Data

US 2015/0075196 A1 Mar. 19, 2015

(30) Foreign Application Priority Data

Apr. 23, 2012 (WO) ..... PCT/JP2012/002776

(51) Int. Cl.
*F25B 13/00* (2006.01)
*F25B 40/00* (2006.01)
(Continued)

(52) U.S. Cl.
CPC ..... *F25B 13/00* (2013.01); *F25B 40/00* (2013.01); *F25B 41/003* (2013.01); *F25B 41/04* (2013.01);
(Continued)

(58) Field of Classification Search
CPC ..... F25B 2400/13; F25B 2600/2509; F25B 13/00; F25B 40/00; F25B 41/003;
(Continued)

(56) References Cited

U.S. PATENT DOCUMENTS 4,409,796 A * 10/1983 Fisher ..... F24D 11/0214 62/160
2004/0025526 A1* 2/2004 Aflekt ..... F24F 3/1405 62/324.1
(Continued)

FOREIGN PATENT DOCUMENTS

JP H02-45382 U 3/1990
JP 2001-235239 A 8/2001
(Continued)

OTHER PUBLICATIONS

Office Action dated Sep. 25, 2015 in the corresponding CN application No. 201380021353.3 (with English translation).
(Continued)

*Primary Examiner* — Jonathan Bradford
(74) *Attorney, Agent, or Firm* — Posz Law Group, PLC

(57) ABSTRACT

In a refrigeration cycle system, switching is allowed between a parallel operation mode and a series operation mode. In the parallel operation mode, a refrigerant, upon leaving a load side heat exchanger, parallelly flows through a high-pressure side passage of each of a first internal heat exchanger and a second internal heat exchanger and then flows into an expansion valve. In the series operation mode, the refrigerant, upon leaving the load side heat exchanger, flows through the high-pressure side passage of the first internal heat exchanger, further flows through the high-pressure side passage of the second internal heat exchanger, and then flows through a high-pressure side bypass pipe into the expansion valve.

17 Claims, 10 Drawing Sheets

(51) Int. Cl.

| | |
|---|---|
| ***F25B 41/00*** | (2006.01) |
| ***F25B 41/04*** | (2006.01) |
| ***F25B 49/02*** | (2006.01) |
| *F25B 47/02* | (2006.01) |

(52) U.S. Cl.
CPC ..... *F25B 41/046* (2013.01); *F25B 49/02* (2013.01); *F25B 47/025* (2013.01); *F25B 2313/0272* (2013.01); *F25B 2313/02741* (2013.01)

(58) Field of Classification Search
CPC ..... F25B 41/04; F25B 41/046; F25B 49/02; F25B 47/025; F25B 2313/0272; F25B 2313/02741; F25B 2313/023; F25B 2313/0232; F25B 2313/0252; F25B 2400/04; F25B 2600/2501
See application file for complete search history.

(56) References Cited

U.S. PATENT DOCUMENTS

2011/0036113 A1* 2/2011 Kopko ..... F25B 30/02 62/324.5
2012/0132399 A1* 5/2012 Christensen ..... F25B 6/00 165/104.19

FOREIGN PATENT DOCUMENTS

| | | | |
|---|---|---|---|
| JP | 2008-2776 | A | 1/2008 |
| JP | 2008-190773 | A | 8/2008 |
| JP | 2008-275249 | A | 11/2008 |
| JP | 2009-204304 | A | 9/2009 |
| JP | 2010-101621 | A | 5/2010 |
| JP | 2010-282384 | A | 12/2010 |
| JP | 4901916 | B2 | 3/2012 |
| WO | 2012/035573 | A1 | 3/2012 |

OTHER PUBLICATIONS

Office Action dated May 7, 2015 issued in corresponding JP patent application No. 2014-512537 (and English translation).
International Search Report of the International Searching Authority dated Jul. 16, 2013 for the corresponding international application No. PCT/JP2013/061680 (and English translation).

* cited by examiner

REFRIGERATION CYCLE SYSTEM WITH INTERNAL HEAT EXCHANGER

CROSS REFERENCE TO RELATED APPLICATIONS

This application is a U.S. national stage application of PCT/JP2013/061680 filed on Apr. 19, 2013, and is based on PCT/JP2012/002776 filed on Apr. 23, 2012, the contents of which are incorporated herein by reference.

TECHNICAL FIELD

The present invention relates to a refrigeration cycle system including an internal heat exchanger that allows a high-pressure refrigerant flowing from the outlet of a condenser to expansion means to exchange heat with a low-pressure refrigerant flowing from the outlet of an evaporator to the suction inlet of a compressor.

BACKGROUND

A refrigeration cycle system has been proposed which includes an internal heat exchanger that allows a high-pressure refrigerant flowing from the outlet of a condenser to expansion means to exchange heat with a low-pressure refrigerant flowing from the outlet of an evaporator to the suction inlet of a compressor. Heat exchange between the high- and low-pressure refrigerants in the internal heat exchanger allows evaporation of a liquid refrigerant flowing from the outlet of the evaporator, thus preventing both return of an excessive amount of liquid refrigerant to the compressor (to be referred to as "liquid back" hereinafter) and burn of the compressor due to a reduction in concentration of lubricating oil. In addition, increasing the difference between the enthalpy at the outlet of the evaporator and that at the inlet of the evaporator reduces the amount of refrigerant circulated, thus improving COP (the quotient of the cooling capacity or heating capacity divided by an input value) (refer to, for example, Patent Literature 1).

PATENT LITERATURE

Patent Literature 1: Japanese Unexamined Patent Application Publication No. 2010-282384

However, according to such a technique disclosed in Patent Literature 1, the amount of heat exchanged in the internal heat exchanger is constant. Hence, for example, if a transient load variation leads to an increase in amount of refrigerant circulated and thus causes liquid back, or if a liquid refrigerant accumulates in a compressor in a defrosting operation, it is impossible to increase the amount of heat exchanged in the internal heat exchanger. When this happens, unfortunately, the liquid back upon the transient load variation reduces the concentration of oil for circulation in the compressor, leading to a lower reliability.

To overcome problems resulting from such transient liquid back, the area of heat transfer can be increased by increasing the length or diameter of each pipe of the internal heat exchanger. Note, however, that in the refrigeration cycle system, pressure loss in a region between the outlet of the evaporator and the suction inlet of the compressor significantly contributes to a reduction in COP. Increasing the length of each pipe of the internal heat exchanger is effective upon liquid back. If no liquid back occurs, however, pressure loss will increase, thus resulting in a reduction in COP. On the other hand, increasing the diameter of each pipe of the internal heat exchanger reduces the flow velocity of the refrigerant, so that refrigerating machine oil fails to return to the compressor upon following the flow of the refrigerant, resulting in burn of the compressor.

If the discharge temperature of the refrigerant discharged from the compressor excessively rises, a magnet of a motor which drives the compressor demagnetizes, so that the performance of the compressor may degrade or become ineffective. In such a case, it is necessary to reduce the quality of the refrigerant at the suction inlet of the compressor to suppress an increase in discharge temperature. Assuming that the capacity of the internal heat exchanger is fixed as in the related art disclosed in Patent Literature 1, even if the discharge temperature abnormally rises, the internal heat exchanger will allow heat exchange. Disadvantageously, it is difficult to reduce the quality of the refrigerant at the suction inlet of the compressor.

SUMMARY

The present invention has been made to overcome the above-described problems, and provides a refrigeration cycle system capable of simultaneously achieving both enhanced reliability and high-efficiency operation upon liquid back or an abnormal increase in discharge temperature.

The present invention provides a refrigeration cycle system including a refrigerant circuit which includes a compressor (1), a load side heat exchanger (3), an internal heat exchanger (4), expansion means (5), and a heat source side heat exchanger (6) connected by pipes, and through which a refrigerant circulates. The internal heat exchanger (4) includes a first internal heat exchanger (7) in which the refrigerant, upon flowing through a high-pressure side passage, exchanges heat with the refrigerant, upon flowing through a low-pressure side passage, a second internal heat exchanger (8) in which the refrigerant, upon flowing through a high-pressure side passage, exchanges heat with the refrigerant, upon flowing through a low-pressure side passage, a first high-pressure side flow switching device (11*a*) disposed between the outlet of the load side heat exchanger (3) and one end of the high-pressure side passage of each of the first internal heat exchanger (7) and the second internal heat exchanger (8), a second high-pressure side flow switching device (12*a*) disposed between the expansion means (5) and the other end of the high-pressure side passage of each of the first internal heat exchanger (7) and the second internal heat exchanger (8), a high-pressure side bypass pipe (13) that branches off from a pipe connecting the first high-pressure side flow switching device (11*a*) and the high-pressure side passage of the second internal heat exchanger (8) and connects to the expansion means (5), and a third high-pressure side flow switching device (12*b*) provided to the high-pressure side bypass pipe (13). Switching is allowed between a parallel operation mode in which the refrigerant, upon leaving the load side heat exchanger (3), parallelly flows through the high-pressure side passages of the first internal heat exchanger (7) and the second internal heat exchanger (8) and then flows into the expansion means (5), and a series operation mode in which the refrigerant, upon leaving the load side heat exchanger (3), flows through the high-pressure side passage of the first internal heat exchanger (7), further flows through the high-pressure side passage of the second internal heat exchanger (8), and then flows through the high-pressure side bypass pipe (13) into the expansion means (5).

According to the present invention, switching is allowed between the parallel operation mode and the series operation mode, thus simultaneously achieving both enhanced reliability and high-efficiency operation upon liquid back or an abnormal increase in discharge temperature.

DETAILED DESCRIPTION

Embodiment 1

Figure 1:
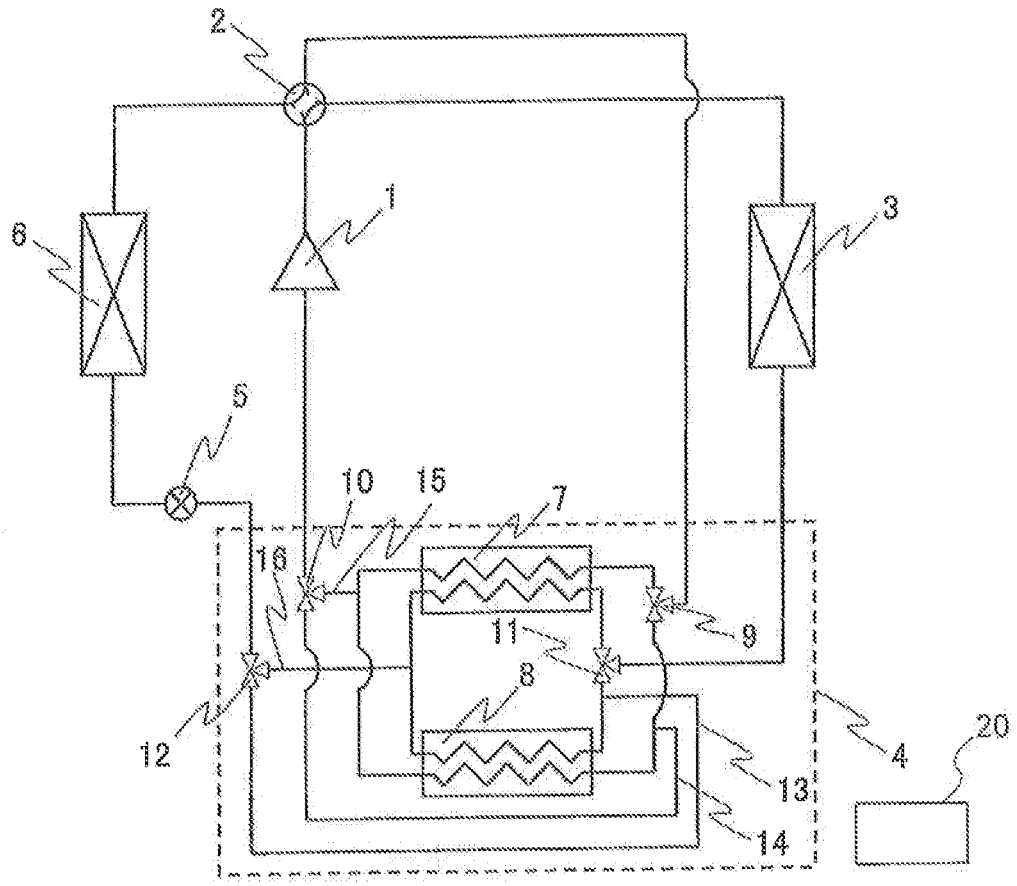
FIG. 1 is a diagram illustrating an exemplary configuration of a refrigeration cycle system according to Embodiment 1.

FIG. 1 is a diagram illustrating the configuration of a refrigeration cycle system according to Embodiment 1.

As illustrated in FIG. 1, the refrigeration cycle system according to Embodiment 1 includes a refrigerant circuit which includes a compressor 1, a four-way valve 2, a load side heat exchanger 3, an internal heat exchanger 4, an expansion valve 5, and a heat source side heat exchanger 6 connected by refrigerant pipes, and through which a refrigerant circulates.

The compressor 1 sucks the refrigerant and compresses the refrigerant to a high-temperature high-pressure state.

The four-way valve 2 is connected to the compressor 1, the load side heat exchanger 3, the internal heat exchanger 4, and the heat source side heat exchanger 6. The four-way valve 2 switches the flow path of the refrigerant discharged from the compressor 1, and the flow path of the refrigerant flowing into the internal heat exchanger 4.

The load side heat exchanger 3 functions as a condenser (radiator) or an evaporator to exchange heat between the refrigerant and a heat medium (for example, air or water) so that the refrigerant condenses and liquefies or evaporates and gasifies. The load side heat exchanger 3 is implemented using, for example, a cross-fin type fin-and-tube heat exchanger including heat transfer tubes and a large number of fins, and exchanges heat between the refrigerant and air (heat medium) supplied from, for example, a fan (not illustrated).

The expansion valve 5 reduces the pressure of the refrigerant to expand it. The expansion valve 5 is implemented using, for example, an electronic expansion valve having a variably controllable opening degree. The expansion valve 5 corresponds to "expansion means" in the present invention.

The heat source side heat exchanger 6 functions as an evaporator or a condenser (radiator) and exchanges heat between the refrigerant and a heat medium (for example, air or water) so that the refrigerant evaporates and gasifies or condenses and liquefies. The heat source side heat exchanger 6 is implemented using, for example, a cross-fin type fin-and-tube heat exchanger including heat transfer tubes and a large number of fins, and exchanges heat between the refrigerant and air (heat medium) supplied from, for example, a fan (not illustrated).

The internal heat exchanger 4 includes a first internal heat exchanger 7, a second internal heat exchanger 8, a first low-pressure side three-way valve 9, a second low-pressure side three-way valve 10, a first high-pressure side three-way valve 11, a second high-pressure side three-way valve 12, a second high-pressure side bypass pipe 13, a second low-pressure side bypass pipe 14, a first low-pressure side bypass pipe 15, and a first high-pressure side bypass pipe 16.

The first internal heat exchanger 7 includes a high-pressure side passage and a low-pressure side passage and exchanges heat between the refrigerant flowing through the high-pressure side passage, and the refrigerant flowing through the low-pressure side passage.

The second internal heat exchanger 8 includes a high-pressure side passage and a low-pressure side passage and exchanges heat between the refrigerant flowing through the high-pressure side passage, and the refrigerant flowing through the low-pressure side passage.

The first high-pressure side three-way valve 11 is disposed between the outlet of the load side heat exchanger 3 and one end (upstream end) of the high-pressure side passage of each of the first and second internal heat exchangers 7 and 8. The first high-pressure side three-way valve 11 connects the high-pressure side passage of the first internal heat exchanger 7, the high-pressure side passage of the second internal heat exchanger 8, and a pipe connecting to the outlet of the load side heat exchanger 3 to switch the flow path of the refrigerant.

The first high-pressure side bypass pipe 16 branches off from a pipe connecting the high-pressure side passages of the first and second internal heat exchangers 7 and 8 and connects to the second high-pressure side three-way valve 12.

The second high-pressure side three-way valve 12 is disposed between the expansion valve 5 and the other end (downstream end) of the high-pressure side passage of each of the first and second internal heat exchangers 7 and 8. The second high-pressure side three-way valve 12 connects the first high-pressure side bypass pipe 16, the second high-pressure side bypass pipe 13, and the expansion valve 5 to switch the flow path of the refrigerant.

The second high-pressure side bypass pipe 13 branches off from a pipe connecting the first high-pressure side three-way valve 11 and the high-pressure side passage of the second internal heat exchanger 8 and connects the high-pressure side passage of the second internal heat exchanger 8 and the second high-pressure side three-way valve 12.

The first high-pressure side three-way valve 11 corresponds to a "first high-pressure side flow switching device" and a "fourth high-pressure side flow switching device" in the present invention. The second high-pressure side three-way valve 12 corresponds to a "second high-pressure side flow switching device" and a "third high-pressure side flow switching device" in the present invention. The second high-pressure side bypass pipe 13 corresponds to a "high-pressure side bypass pipe" in the present invention.

The first low-pressure side three-way valve 9 is disposed between the outlet of the heat source side heat exchanger 6 and one end (upstream end) of the low-pressure side passage of each of the first and second internal heat exchangers 7 and 8. The first low-pressure side three-way valve 9 connects the low-pressure side passage of the first internal heat exchanger 7, the low-pressure side passage of the second internal heat exchanger 8, and the pipe connecting to the outlet of the heat source side heat exchanger 6 to switch the flow path of the refrigerant.

The first low-pressure side bypass pipe 15 branches off from a pipe connecting the low-pressure side passages of the first and second internal heat exchangers 7 and 8 and connects to the second low-pressure side three-way valve 10.

The second low-pressure side three-way valve 10 is disposed between the compressor 1 and the other end (downstream end) of the low-pressure side passage of each of the first and second internal heat exchangers 7 and 8. The second low-pressure side three-way valve 10 connects the first low-pressure side bypass pipe 15, the second low-pressure side bypass pipe 14, and the compressor 1 to switch the flow path of the refrigerant.

The second low-pressure side bypass pipe 14 branches off from a pipe connecting the first low-pressure side three-way valve 9 and the low-pressure side passage of the second internal heat exchanger 8 and connects the low-pressure side passage of the second internal heat exchanger 8 and the second low-pressure side three-way valve 10.

The first low-pressure side three-way valve 9 corresponds to a "first low-pressure side flow switching device" and a "fourth low-pressure side flow switching device" in the present invention. The second low-pressure side three-way valve 10 corresponds to a "second low-pressure side flow switching device" and a "third low-pressure side flow switching device" in the present invention. The second low-pressure side bypass pipe 14 corresponds to a "low-pressure side bypass pipe" in the present invention.

Each of the first high-pressure side three-way valve 11, the second high-pressure side three-way valve 12, the first low-pressure side three-way valve 9, and the second low-pressure side three-way valve 10 is not limited to a three-way valve and may be any component capable of switching the flow path of the refrigerant. For example, a plurality of components, such as on-off valves, for opening or closing a two-way passage may be used in combination to switch the flow path of the refrigerant.

A controller 20 includes a microcomputer and controls, for example, the driving frequency of the compressor 1, switching of the four-way valve 2, and the opening degree of the expansion valve 5. The controller 20 controls the first high-pressure side three-way valve 11, the second high-pressure side three-way valve 12, the first low-pressure side three-way valve 9, and the second low-pressure side three-way valve 10 to switch the flow path of the refrigerant, thereby executing any of operation modes, which will be described later.

The operation of the refrigeration cycle system according to Embodiment 1 will now be described.

In the refrigeration cycle system according to Embodiment 1, switching is allowed among a parallel operation mode, a series operation mode, and a bypass operation mode.

The "parallel operation mode" will now first be described.

Figure 2:
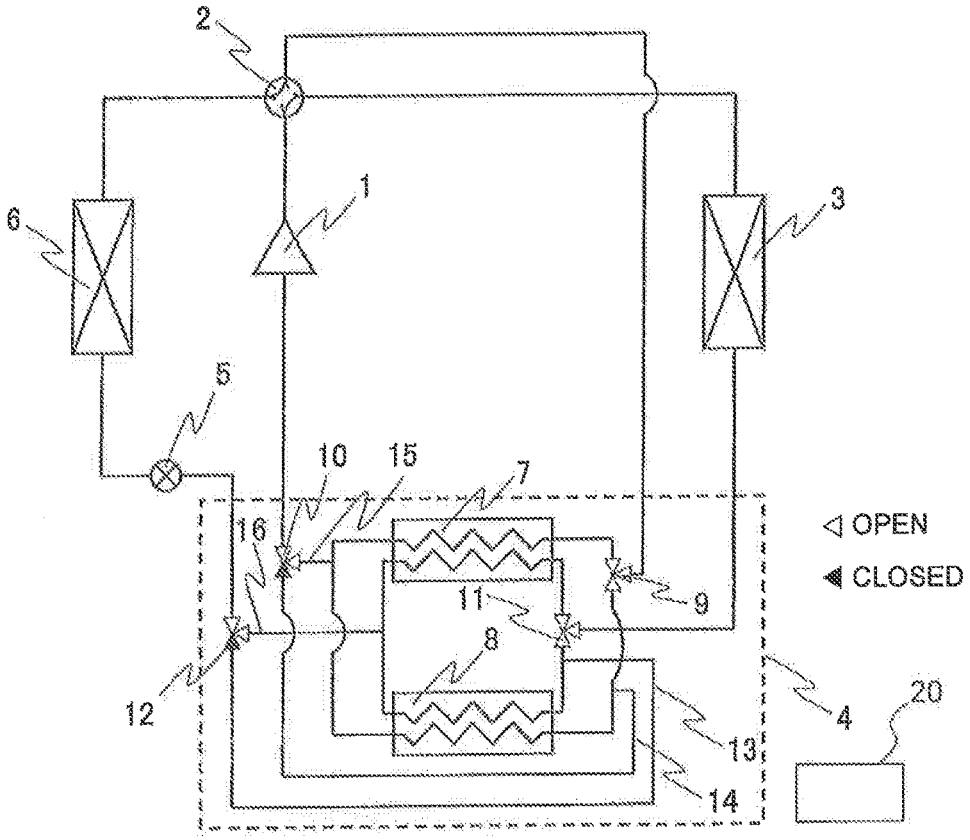
FIG. 2 is a diagram illustrating the configuration of a refrigerant circuit in a "parallel operation mode" according to Embodiment 1.

FIG. 2 is a diagram illustrating the configuration of the refrigerant circuit in the "parallel operation mode" according to Embodiment 1.

In the parallel operation mode, the first high-pressure side three-way valve 11 is set so that the refrigerant, upon leaving the load side heat exchanger 3, flows into both the high-pressure side passages of the first and second internal heat exchangers 7 and 8.

The second high-pressure side three-way valve 12 is set so that the refrigerant passing through the high-pressure side passages of the first and second internal heat exchangers 7 and 8 and further passing through the first high-pressure side bypass pipe 16 flows into the expansion valve 5, and the refrigerant passing through the second high-pressure side bypass pipe 13 does not flow into the expansion valve 5.

The first low-pressure side three-way valve 9 is set so that the refrigerant, upon leaving the heat source side heat exchanger 6 and passing through the four-way valve 2, flows into both the low-pressure side passages of the first and second internal heat exchangers 7 and 8.

The second low-pressure side three-way valve 10 is set so that the refrigerant passing through the low-pressure side passages of the first and second internal heat exchangers 7 and 8 and further passing through the first low-pressure side bypass pipe 15 flows into the compressor 1, and the refrigerant passing through the second low-pressure side bypass pipe 14 does not flow into the compressor 1.

With this operation, the refrigerant, upon leaving the load side heat exchanger 3, parallelly flows through the high-pressure side passages of the first and second internal heat exchangers 7 and 8 and then flows into the expansion valve 5. The refrigerant, upon leaving the heat source side heat exchanger 6, parallelly flows through the low-pressure side passages of the first and second internal heat exchangers 7 and 8 and then flows into the compressor 1.

The functions of the components and the states of the refrigerant will now be described in accordance with the flow of the refrigerant in a heating operation with reference to FIG. 3.

Figure 3:
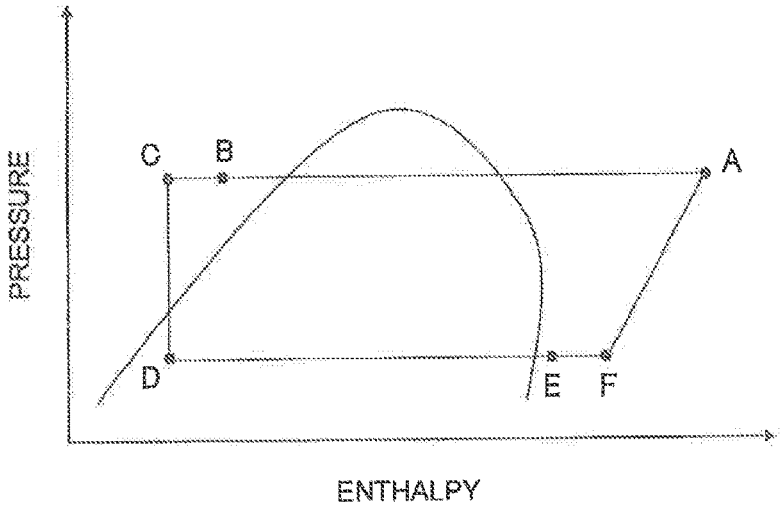
FIG. 3 is a pressure-enthalpy graph illustrating cycle characteristics in the "parallel operation mode" according to Embodiment 1.

FIG. 3 is a pressure-enthalpy graph illustrating cycle characteristics in the "parallel operation mode" according to Embodiment 1.

The refrigerant discharged from the compressor 1 is a high-temperature high-pressure gas refrigerant (point A). The high-temperature high-pressure gas refrigerant passes through the four-way valve 2 and then exchanges heat with a heat medium (for example, air or water) in the load side heat exchanger 3, and condenses into a high-pressure liquid refrigerant (point B). In the internal heat exchanger 4, the refrigerant flows in parallel through the first and second internal heat exchangers 7 and 8 such that the high-pressure liquid refrigerant exchanges heat with a low-pressure gas refrigerant, thus cooling the high-pressure liquid refrigerant (point C). The high-pressure liquid refrigerant is reduced in pressure by the expansion valve 5 into a low-pressure two-phase refrigerant (point D). The low-pressure two-phase refrigerant exchanges heat with a heat medium (for example, air or water) in the heat source side heat exchanger 6 and thus evaporates (point E). In the internal heat exchanger 4, the refrigerant flows in parallel through the first and second internal heat exchangers 7 and 8 such that the high-pressure liquid refrigerant exchanges heat with the low-pressure gas refrigerant, thereby being superheated (point F). The refrigerant returns to the suction inlet of the compressor 1.

To promote and control heat exchange in the load side heat exchanger 3 and the heat source side heat exchanger 6, for example, a fan may be used to increase the flow rate of air when the heat medium is air. Alternatively, when the heat medium is a liquid, such as water, a pump or the like may be used to increase the flow rate of water. The same applies to other operation modes, which will be described later.

If transient liquid back is caused by load variations or a defrosting operation in the refrigeration cycle system, the concentration of lubricating oil (to be referred to as "refrigerating machine oil" hereinafter) for the compressor 1 would be reduced, thus resulting in burn of the compressor due to inadequate lubrication.

To cope with such transient liquid back, the heat transfer area can be increased by increasing the length or diameter of each pipe of the internal heat exchanger 4, as in the related art described in Patent Literature 1. Note, however, that in the refrigeration cycle system, pressure loss in a region between the outlet of the evaporator and the suction inlet of the compressor significantly contributes to a reduction in COP. Increasing the length of each pipe of the internal heat exchanger 4 is effective upon liquid back. If no liquid back occurs, however, pressure loss would increase, thus resulting in a reduction in COP. On the other hand, increasing the diameter of each pipe of the internal heat exchanger 4 would reduce the flow velocity of the refrigerant, so that refrigerating machine oil would fail to return to the compressor 1 upon following the flow of the refrigerant, resulting in burn of the compressor 1.

In the "parallel operation mode" according to Embodiment 1, the cross-sectional areas of the first internal heat exchanger 7 and the second internal heat exchanger 8 are set to achieve a flow velocity of the refrigerant at which the refrigerating machine oil can return to the compressor 1 upon following the flow of the refrigerant. With the settings, heat exchange can be achieved while pressure loss is kept low. Advantageously, a high-COP operation can be achieved with high reliability.

If transient liquid back is caused by load variations or the like in the "parallel operation mode", the amount of liquid refrigerant returning to the suction inlet of the compressor 1 has to be reduced as rapidly as possible.

In this case, in the refrigeration cycle system according to Embodiment 1, switching is made to the "series operation mode".

The "series operation mode" will now be described next.

Figure 4:
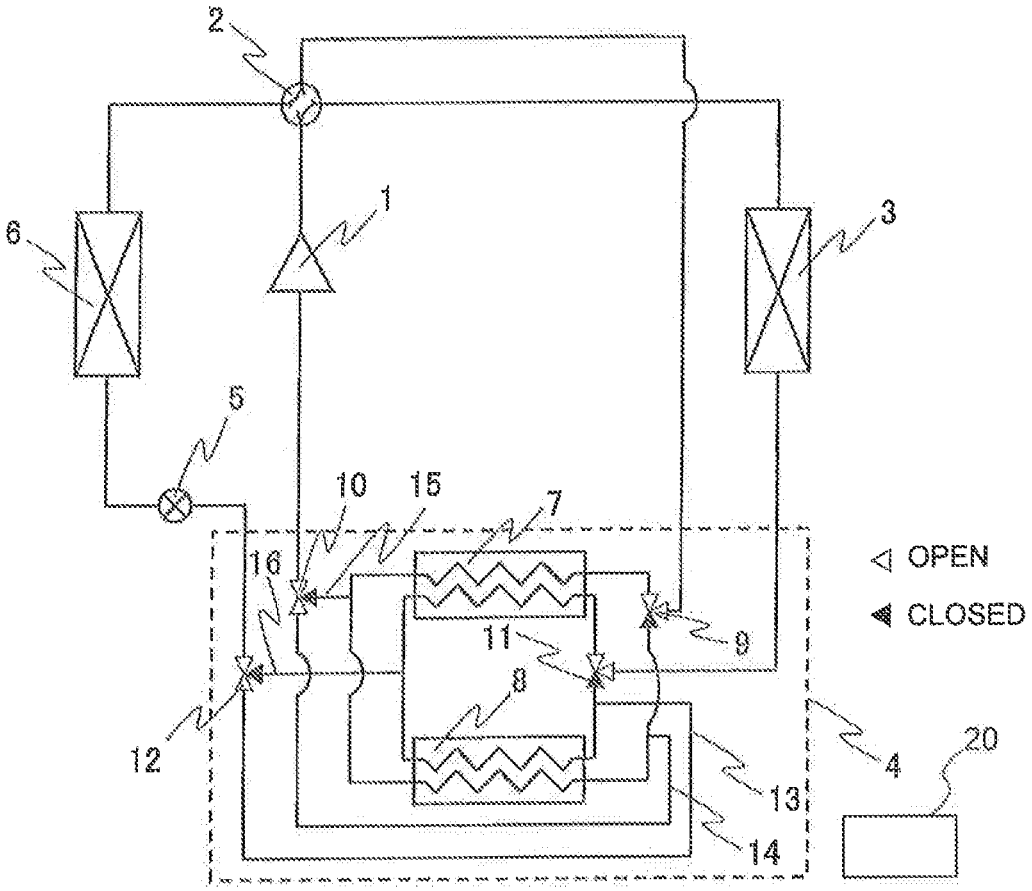
FIG. 4 is a diagram illustrating the configuration of the refrigerant circuit in a "series operation mode" according to Embodiment 1.

FIG. 4 is a diagram illustrating the configuration of the refrigerant circuit in the "series operation mode" according to Embodiment 1.

In the series operation mode, the first high-pressure side three-way valve 11 is set so that the refrigerant, upon leaving the load side heat exchanger 3, flows into the high-pressure side passage of the first internal heat exchanger 7 and does not flow into the high-pressure side passage of the second internal heat exchanger 8.

The second high-pressure side three-way valve 12 is set so that the refrigerant passing through the high-pressure side passage of the first internal heat exchanger 7 does not flow through the first high-pressure side bypass pipe 16 into the expansion valve 5, and the refrigerant passing through the second high-pressure side bypass pipe 13 flows into the expansion valve 5.

The first low-pressure side three-way valve 9 is set so that the refrigerant, upon leaving the heat source side heat exchanger 6 and passing through the four-way valve 2, flows into the low-pressure side passage of the first internal heat exchanger 7 and does not flow into the low-pressure side passage of the second internal heat exchanger 8.

The second low-pressure side three-way valve 10 is set so that the refrigerant passing through the low-pressure side passage of the first internal heat exchanger 7 does not flow through the first low-pressure side bypass pipe 15 into the compressor 1, and the refrigerant passing through the second low-pressure side bypass pipe 14 flows into the compressor 1.

With this operation, the refrigerant, upon leaving the load side heat exchanger 3, flows through the high-pressure side passage of the first internal heat exchanger 7, further flows through the high-pressure side passage of the second internal heat exchanger 8, and then flows through the second high-pressure side bypass pipe 13 into the expansion valve 5. The refrigerant, upon leaving the heat source side heat exchanger 6, flows through the low-pressure side passage of the first internal heat exchanger 7, further flows through the low-pressure side passage of the second internal heat exchanger 8, and then flows through the second low-pressure side bypass pipe 14 into the compressor 1.

The functions of the components and the states of the refrigerant will now be described in accordance with the flow of the refrigerant in the heating operation with reference to FIG. 5.

Figure 5:
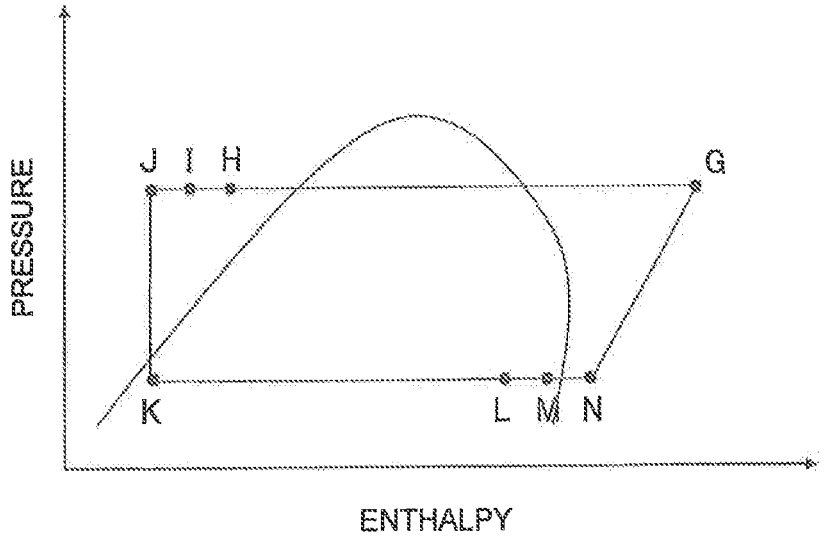
FIG. 5 is a pressure-enthalpy graph illustrating cycle characteristics in the "series operation mode" according to Embodiment 1.

FIG. 5 is a pressure-enthalpy graph illustrating cycle characteristics in the "series operation mode" according to Embodiment 1.

The refrigerant discharged from the compressor 1 is a high-temperature high-pressure gas refrigerant (point G). The high-temperature high-pressure gas refrigerant passes through the four-way valve 2 and exchanges heat with a heat medium (for example, air or water) in the load side heat exchanger 3, and condenses into a high-pressure liquid refrigerant (point H). In the internal heat exchanger 4, the refrigerant flows in series through the first and second internal heat exchangers 7 and 8 such that the high-pressure liquid refrigerant exchanges heat with a low-pressure gas refrigerant. Consequently, the high-pressure liquid refrigerant is cooled in two stages (points I and J), namely, in the first internal heat exchanger 7 and the second internal heat exchanger 8. The high-pressure liquid refrigerant is reduced in pressure by the expansion valve 5 into a low-pressure two-phase refrigerant (point K). The low-pressure two-phase refrigerant exchanges heat with a heat medium (for example, air or water) in the heat source side heat exchanger 6 and thus evaporates (point L). In the internal heat exchanger 4, the refrigerant flows in series through the first and second internal heat exchangers 7 and 8 such that the high-pressure liquid refrigerant exchanges heat with the low-pressure gas refrigerant. Consequently, the refrigerant is superheated in two stages (points M and N), namely, in the first internal heat exchanger 7 and the second internal heat exchanger 8. The refrigerant then returns to the suction inlet of the compressor 1.

Advantages in the "series operation mode" will now be described.

The difference between "parallel operation mode" and the "series operation mode" lies in that in the former mode the first internal heat exchanger 7 and the second internal heat exchanger 8 are in parallel with the direction in which the refrigerant flows in the internal heat exchanger 4, while in the latter mode the first internal heat exchanger 7 and the second internal heat exchanger 8 are in series with the direction in which the refrigerant flows in the internal heat exchanger 4. The heat transfer area for heat exchange between the high- and low-pressure refrigerants is the same in the arrangement in which the first and second internal heat exchangers 7 and 8 are arranged in series with the direction in which the refrigerant flows as in the arrangement in which the first and second internal heat exchangers 7 and 8 are arranged in parallel with the direction in which the refrigerant flows, while the heat transfer coefficient is higher in the former, series arrangement than in the latter, parallel arrangement. Accordingly, if liquid back occurs, the reliability in the "series operation mode" is higher than that in the "parallel operation mode" because in the former mode the internal heat exchanger 4 exhibits higher heat transfer performance and thus allows the liquid refrigerant, upon returning to the suction inlet of the compressor 1, to evaporate more.

In general, an amount of heat exchange Q, a heat transfer area A of a heat exchanger, a heat transfer coefficient K, and a temperature difference dT between high- and low-pressure refrigerants have a relation expressed by Expression (1).

[Math. 1]

$$Q=A\cdot K\cdot dT \tag{1}$$

The heat transfer area A when the refrigerant flows in parallel through the first and second internal heat exchangers 7 and 8 is the same as that when the refrigerant flows in series through the first and second internal heat exchangers 7 and 8. Also, the temperature difference dT when the refrigerant flows in parallel through the first and second internal heat exchangers 7 and 8 is substantially the same as that when the refrigerant flows in series through the first and second internal heat exchangers 7 and 8. Accordingly, the amount of heat exchange Q in the internal heat exchanger 4 is significantly affected by the heat transfer coefficient K.

The heat transfer coefficient K is expressed as the well-known Dittus-Boelter equation, which typifies a function describing single-phase turbulent flow, as per Expression (2).

[Math. 2]

$$Nu=0.023\cdot Re^{0.8}\cdot Pr^{0.4} \tag{2}$$

$$Nu=\alpha\cdot d/\lambda$$

$$Re=u\cdot d/\nu$$

$$Pr=\nu/a$$

$$K=(1/\alpha_i+\delta/\lambda'+1/\alpha_o)$$

where $\alpha$ is the heat transfer coefficient, d is the representative length, $\lambda$ is the coefficient of kinematic viscosity, u is the flow velocity of the refrigerant, $\nu$ is the coefficient of kinematic viscosity, a is the temperature conductivity, $\delta$ is the thickness of a plate separating a high-pressure side and a low-pressure side, $\lambda'$ is the thermal conductivity of the plate separating the high-pressure side and the low-pressure side, $\alpha_i$ is the heat transfer coefficient on the inner side of a tube, and $\alpha_o$ is the heat transfer coefficient on the outer side of the tube.

In the Dittus-Boelter equation, Nu is a dimensionless number that represents the magnitude of heat transfer, Pr is a dimensionless number that represents the influence of physical properties, and Re is a dimensionless number that represents the influence of turbulence of the flow.

Assuming that the physical properties in the case where the refrigerant flows in parallel through the first and second internal heat exchangers 7 and 8 are the same as those in the case where the refrigerant flows in series through the first and second internal heat exchangers 7 and 8, Pr in the former case is the same as that in the latter case. Accordingly, Nu is affected most by Re.

In the parallel operation mode, the refrigerant is divided into two streams: one stream of refrigerant which flows through the first internal heat exchanger 7 and the other stream of refrigerant which flows through the second internal heat exchanger 8. On the other hand, in the series operation mode, the refrigerant passes through the first internal heat exchanger 7 and then passes through the second internal heat exchanger 8. With this operation, the flow rate of the refrigerant flowing through the first and second internal heat exchangers 7 and 8 in the series operation mode is twice as much as that in the parallel operation mode. In the series operation mode, therefore, the increased flow velocity of the refrigerant increases Re, thus promoting heat transfer. A larger amount of heat exchange can be obtained.

Specifically, when liquid back occurs, the series operation mode is performed so that the refrigerant flows in series through the first internal heat exchanger 7 and the second internal heat exchanger 8. With this operation, the amount of heat exchange in the internal heat exchanger 4 can be increased, thus allowing more liquid refrigerant to gasify and return to the suction inlet of the compressor 1. Accordingly, the dilution of the refrigerating machine oil with the liquid refrigerant can be reduced, thus enhancing the reliability.

As regards further advantages of the series operation mode, the rate of rise of heating capacity upon the start of the system or during transition from the defrosting operation to a normal operation (or upon return from the defrosting operation) can be increased. Upon the start of the system or return from the defrosting operation, the pipes and the heat exchangers included in the refrigeration cycle system are cold. Accordingly, the cold pipes and heat exchangers have to be temporarily heated upon the start of the system or return from the defrosting operation. It takes a certain time to supply high-temperature air or water to the load side. Disadvantageously, this causes a user to feel discomfort.

The "series operation mode" is performed upon the start of the system or return from the defrosting operation, so that the quality of the refrigerant at the suction inlet of the compressor 1 can be increased. Consequently, the discharge temperature of the refrigerant discharged from the compressor 1 rises, so that the cold pipes and heat exchangers can be efficiently heated. Thus, high-temperature air or water can be quickly supplied to the load side.

A control operation to switch the operation to the series operation mode when the occurrence of liquid back to the compressor 1 is detected in the parallel operation mode will now be described.

Figure 6:
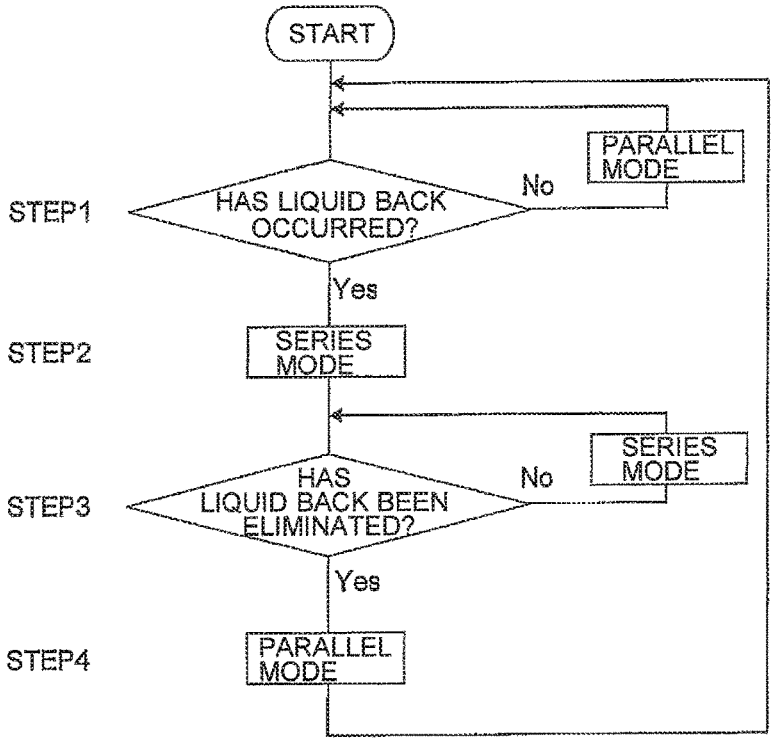
FIG. 6 is a flowchart showing the sequence of control upon liquid back in the "series operation mode" according to Embodiment 1.

FIG. 6 is a flowchart showing the sequence of control upon liquid back in the "series operation mode" according to Embodiment 1. This sequence of control will be described with reference to FIG. 6.

In STEP 1, the controller determines whether liquid back has occurred. As regards the determination of liquid back, for example, a pressure sensor and a temperature sensor are attached to the discharge outlet of the compressor 1. When the degree of discharge superheat, that is, the difference between a temperature measured by the temperature sensor and a refrigerant saturation temperature, obtained from a pressure measured by the pressure sensor, is lower than a predetermined value, the controller determines that liquid back has occurred. Alternatively, for example, a pressure sensor and a temperature sensor are attached to the suction inlet of the compressor 1. When the degree of suction superheat, that is, the difference between a temperature measured by the temperature sensor and a refrigerant saturation temperature, obtained from a pressure measured by the pressure sensor, is lower than a predetermined value, the controller determines that liquid back has occurred.

If the controller determines in STEP 1 that liquid back has not occurred, it switches the operation to the "parallel operation mode" and continues to determine whether liquid back has occurred.

If the controller determines in STEP 1 that liquid back has occurred, it switches the operation to the "series operation mode" in STEP 2.

In STEP 3, the controller determines whether liquid back has continuously occurred after the operation is switched to the "series operation mode". If liquid back has continuously occurred, the operation in the "series operation mode" is continued.

If the controller determines in STEP 3 that the liquid back has been eliminated, it switches the operation to the "parallel operation mode" in STEP 4 and returns to STEP 1 to repeat the above-described operations.

If the operation is switched between the "parallel operation mode" and the "series operation mode" immediately after it is determined whether liquid back has occurred, the devices may become unstable due to frequent switching when the system is operating before and after determination as to whether liquid back has occurred. Therefore, the duration in which liquid back is continued or the threshold value preferably includes an allowance to provide a differential.

An operation to control switching to the series operation mode when the operation of the refrigeration cycle system is started (upon the start of the system) or the defrosting operation is ended (upon return from the defrosting operation) will now be described.

Figure 7:
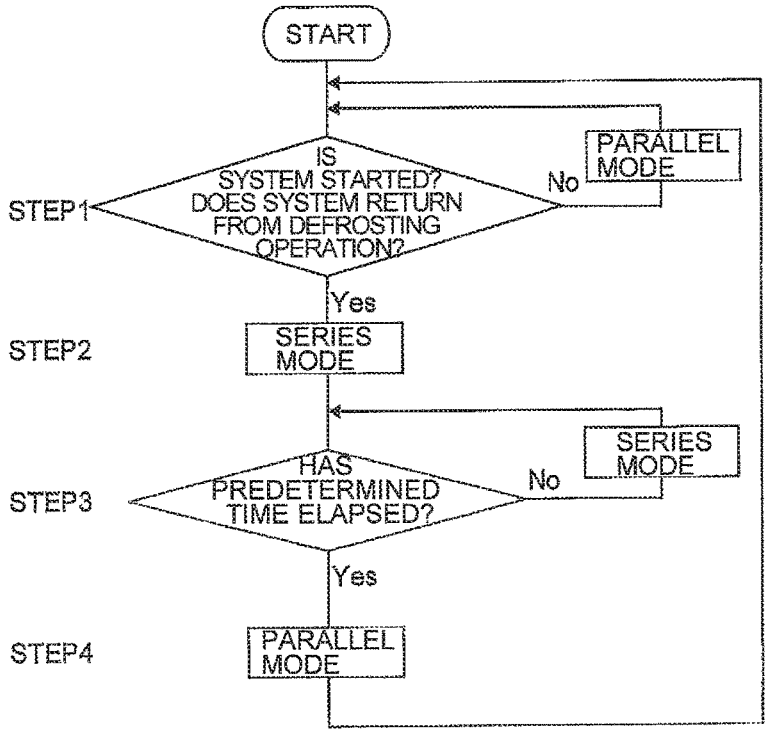
FIG. 7 is a flowchart showing the sequence of control for the "series operation mode" according to Embodiment 1 upon the start of the system or upon return from a defrosting operation.

FIG. 7 is a flowchart showing the sequence of control for the "series operation mode" according to Embodiment 1 upon the start of the system or upon return from the defrosting operation.

In STEP 1, the controller determines whether the refrigeration cycle system is started or the system returns from the defrosting operation. As regards the determination of the start of the system, when the operation of the refrigeration cycle system is started in accordance with an operation instruction from, for example, a remote controller, the controller determines that the system is started. As regards the determination of return from the defrosting operation, for example, assuming that the defrosting operation is performed using hot gas, when the four-way valve 2 is temporarily switched in the defrosting operation so that hot gas is supplied from the compressor 1 to the heat source side heat exchanger 6 which functions as an evaporator in the heating operation and the four-way valve 2 is then switched so that the heat source side heat exchanger 6 again functions as an evaporator, the controller determines that the system returns from the defrosting operation.

If neither the start of the system nor return from the defrosting operation is detected in STEP 1, the controller switches the operation to the "parallel operation mode" and continues to determine whether the system is started or the system returns from the defrosting operation.

If the start of the system or return from the defrosting operation is detected in STEP 1, the controller switches the operation to the "series operation mode" in STEP 2.

In STEP 3, the controller determines whether a predetermined time has elapsed after the "series operation mode" is enabled. If the predetermined time has not yet elapsed, the controller continues the operation in the "series operation mode". As regards the predetermined time, for example, a period of time required to sufficiently heat the devices is set.

If the controller determines in STEP 3 that the predetermined time has elapsed, it switches the operation to the "parallel operation mode" in STEP 4 and returns to STEP 1 to repeat the above-described operations.

Although switching to the parallel operation mode is made depending on the result of determination in STEP 3 as to whether the predetermined time has elapsed, this may be done using another criterion of determination. For example, when the degree of superheat or the temperature of the refrigerant at the discharge outlet of the compressor 1 is equal to or higher than a predetermined value, the operation may be switched to the parallel operation mode.

The "bypass operation mode" will now be described.

If the discharge temperature of the refrigerant discharged from the compressor 1 excessively rises, a magnet of a motor which drives the compressor demagnetizes, so that the performance of the compressor may degrade or become ineffective. In such a case, it is necessary to reduce the quality of the refrigerant at the suction inlet of the compressor 1 to suppress an increase in discharge temperature. Assuming that the capacity of the internal heat exchanger is fixed as in the related art disclosed in Patent Literature 1, even if the discharge temperature abnormally rises, the internal heat exchanger would allow heat exchange. Disadvantageously, it is difficult to reduce the quality of the refrigerant at the suction inlet of the compressor.

In the "bypass operation mode" of the refrigeration cycle system according to Embodiment 1, the amount of heat exchange in the internal heat exchanger 4 can be kept zero, thus immediately coping with an abnormal increase in discharge temperature. This leads to enhanced reliability.

Figure 8:
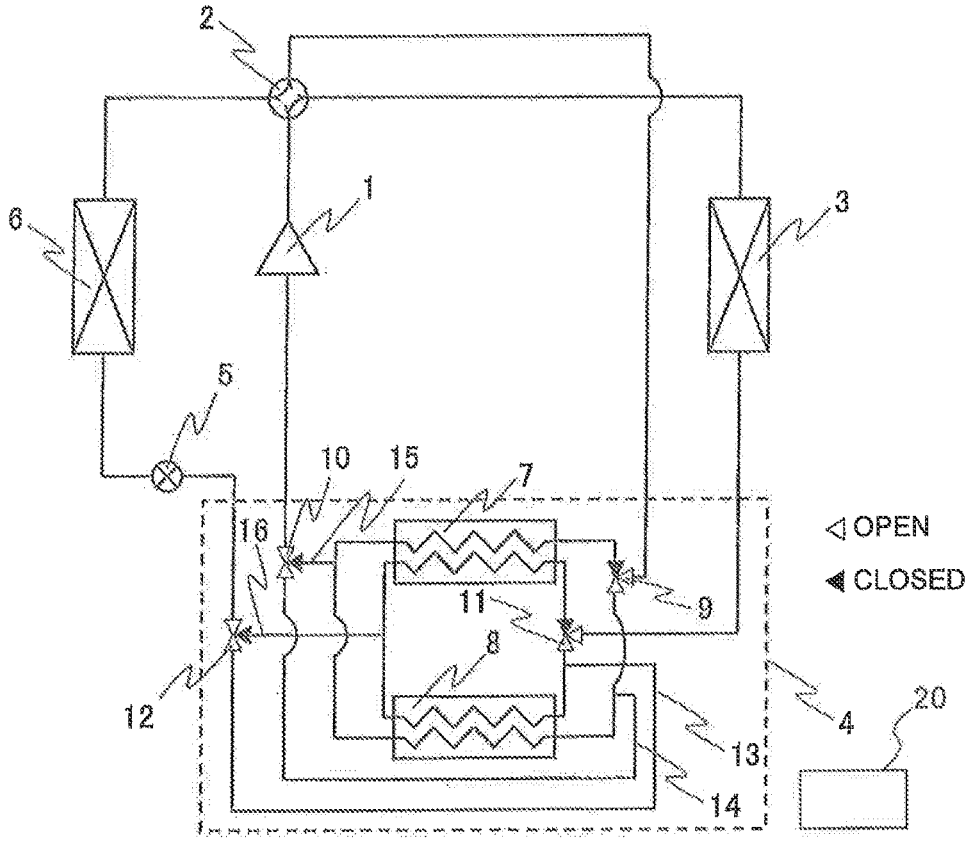
FIG. 8 is a diagram illustrating the configuration of the refrigerant circuit in a "bypass operation mode" according to Embodiment 1.

FIG. 8 is a diagram illustrating the configuration of the refrigerant circuit in the "bypass operation mode" according to Embodiment 1.

In the bypass operation mode, the first high-pressure side three-way valve 11 is set so that the refrigerant, upon leaving the load side heat exchanger 3, does not flow into the high-pressure side passage of the first internal heat exchanger 7 and flows into the second high-pressure side bypass pipe 13.

The second high-pressure side three-way valve 12 is set so that the refrigerant passing through the high-pressure side passage of the second internal heat exchanger 8 does not flow into the expansion valve 5 through the first high-pressure side bypass pipe 16, and the refrigerant passing through the second high-pressure side bypass pipe 13 flows into the expansion valve 5.

The first low-pressure side three-way valve 9 is set so that the refrigerant, upon leaving the heat source side heat exchanger 6 and passing through the four-way valve 2, does not flow into the low-pressure side passage of the first internal heat exchanger 7 and flows into the second low-pressure side bypass pipe 14.

The second low-pressure side three-way valve 10 is set so that the refrigerant, upon passing through the low-pressure side passage of the second internal heat exchanger 8, does not flow into the compressor 1 through the first low-pressure side bypass pipe 15, and the refrigerant, upon passing through the second low-pressure side bypass pipe 14, flows into the compressor 1.

With this operation, the refrigerant, upon leaving the load side heat exchanger 3, flows through the second high-pressure side bypass pipe 13 into the expansion valve 5 without passing through the first and second internal heat exchangers 7 and 8. The refrigerant, upon leaving the heat source side heat exchanger 6, flows through the second low-pressure side bypass pipe 14 into the compressor 1 without passing through the first and second internal heat exchangers 7 and 8.

The functions of the components and the states of the refrigerant will now be described in accordance with the flow of the refrigerant in the heating operation with reference to FIG. 9.

Figure 9:
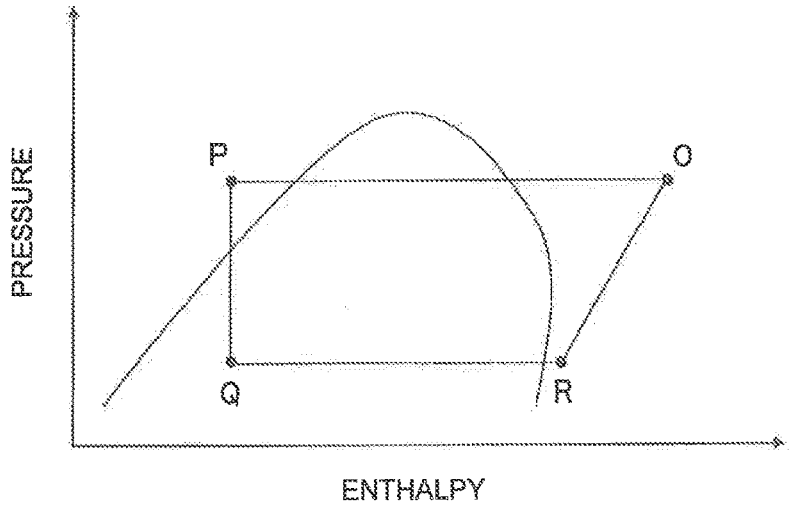
FIG. 9 is a pressure-enthalpy graph illustrating cycle characteristics in the "bypass operation mode" according to Embodiment 1.

FIG. 9 is a pressure-enthalpy graph illustrating cycle characteristics in the "bypass operation mode" according to Embodiment 1.

The refrigerant discharged from the compressor 1 is a high-temperature high-pressure gas refrigerant (point O). The high-temperature high-pressure gas refrigerant passes through the four-way valve 2 and exchanges heat with a heat medium (for example, air or water) in the load side heat exchanger 3, and condenses into a high-pressure liquid refrigerant (point P). The high-pressure liquid refrigerant leaving the load side heat exchanger 3 bypasses the internal heat exchanger 4 and flows into the expansion valve 5 (point P). The high-pressure liquid refrigerant is reduced in pressure by the expansion valve 5 into a low-pressure two-phase refrigerant (point Q). The low-pressure two-phase refrigerant exchanges heat with a heat medium (for example, air or water) in the heat source side heat exchanger 6 and thus evaporates (point R). The refrigerant leaving the heat source side heat exchanger 6 bypasses the internal heat exchanger 4 (point R) and returns to the suction inlet of the compressor 1.

In the refrigerant circuit with the above-described configuration, the amount of heat exchange in the internal heat exchanger 4 can be kept zero. If the discharge temperature of the refrigerant discharged from the compressor 1 abnormally rises, the quality of the refrigerant at the suction inlet of the compressor 1 can be reduced, thus enhancing the reliability.

An operation to control switching between the parallel operation mode and the bypass operation mode will now be described.

Figure 10:
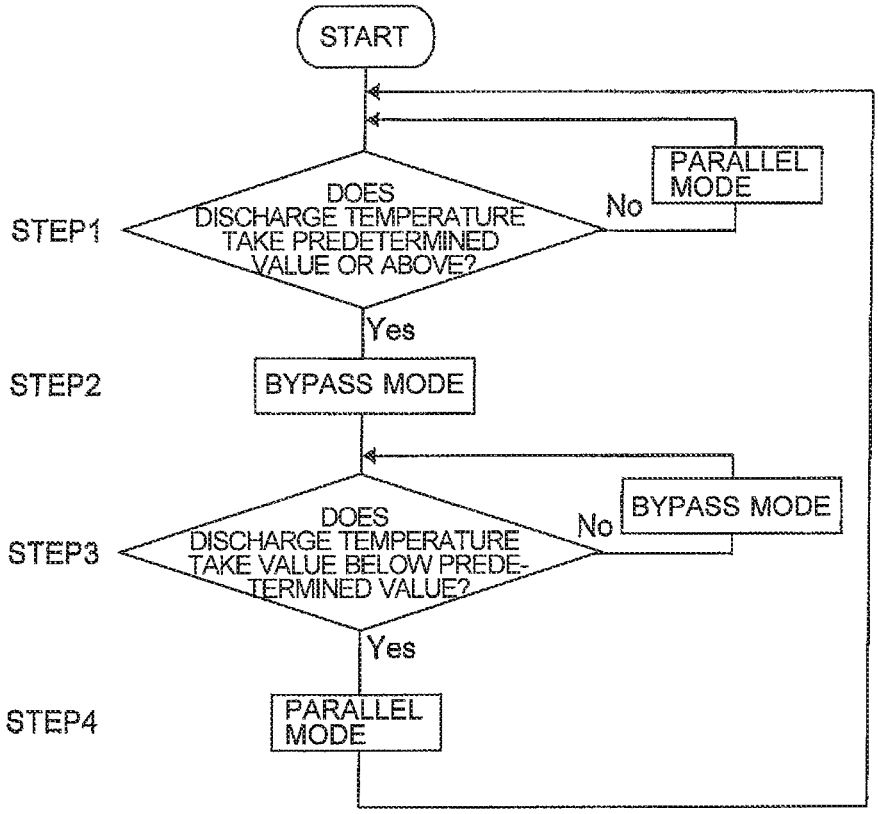
FIG. 10 is a flowchart showing the sequence of control for the "bypass operation mode" according to Embodiment 1.

FIG. 10 is a flowchart showing the sequence of control for the "bypass operation mode" according to Embodiment 1. This sequence of control will be described with reference to FIG. 10.

In STEP 1, the controller determines whether the temperature (discharge temperature) of the refrigerant at the discharge outlet of the compressor 1 takes a predetermined value or above. A temperature sensor is preferably disposed at the discharge outlet of the compressor 1 to detect the discharge temperature.

If the controller determines in STEP 1 that the discharge temperature does not take the predetermined value or above, it switches the operation to the "parallel operation mode" and continues to determine whether the discharge temperature takes the predetermined value or above.

If the controller determines in STEP 1 that the discharge temperature takes the predetermined value or above, it switches the operation to the "bypass operation mode" in STEP 2.

After switching the operation to the "bypass operation mode", the controller determines in STEP 3 whether the discharge temperature takes a value below the predetermined value. If the controller determines that the discharge temperature does not take a value below the predetermined value, it continues the operation in the "bypass operation mode".

If the controller determines in STEP 3 that the discharge temperature takes a value below the predetermined value, it switches the operation to the "parallel operation mode" in STEP 4 and returns to STEP 1 to repeat the above-described operations.

If the refrigeration cycle system is operating while the discharge temperature takes a value around the predetermined value, serving as a criterion of determination as to whether to switch the operation to the "bypass operation mode", the devices may become unstable due to frequent switching between the "bypass operation mode" and the "parallel operation mode". Therefore, the duration or the threshold value preferably includes an allowance to provide a differential.

In the above description, a refrigerant stream passing through the high-pressure side passage, and a refrigerant stream passing through the low-pressure side passage flow in parallel flow in each of the first and second internal heat exchangers 7 and 8. However, a refrigerant stream passing through the high-pressure side passage, and a refrigerant stream passing through the low-pressure side passage may flow in counter flow in each of the first and second internal heat exchangers 7 and 8. The use of such counter flow can further increase the amount of heat exchange.

As described above, according to Embodiment 1, when liquid back has occurred due to transient load variations, the series operation mode is set. Thus, the heat transfer performance of the internal heat exchanger 4 can be increased and a liquid back state can accordingly be eliminated. This leads to enhanced reliability.

If liquid back has not occurred or the discharge temperature is normal, the parallel operation mode is set. Consequently, the amount of heat exchange in the internal heat exchanger 4 can be increased or pressure loss can be reduced depending on the circumstances involved. Thus, both the reliability and the efficiency can be increased.

In addition, when the discharge temperature of the refrigerant discharged from the compressor 1 excessively rises, the bypass operation mode is set. Consequently, the amount of heat exchange in the internal heat exchanger 4 can be kept zero. Thus, the discharge temperature can quickly be reduced.

The first high-pressure side three-way valve 11, which is a single component, includes a "first high-pressure side flow switching device" and a "fourth high-pressure side flow switching device" in the present invention. The second high-pressure side three-way valve 12, which is a single component, includes a "second high-pressure side flow switching device" and a "third high-pressure side flow switching device" in the present invention. The first low-pressure side three-way valve 9, which is a single component, includes a "first low-pressure side flow switching device" and a "fourth low-pressure side flow switching device" in the present invention. The second low-pressure side three-way valve 10, which is a single component, includes a "second low-pressure side flow switching device" and a "third low-pressure side flow switching device" in the present invention. Accordingly, the number of valves is smaller than that in a configuration in which a valve is provided for each switching device. This obviates the need for a complicated arrangement of pipes, thus downsizing a unit.

Figure 12:
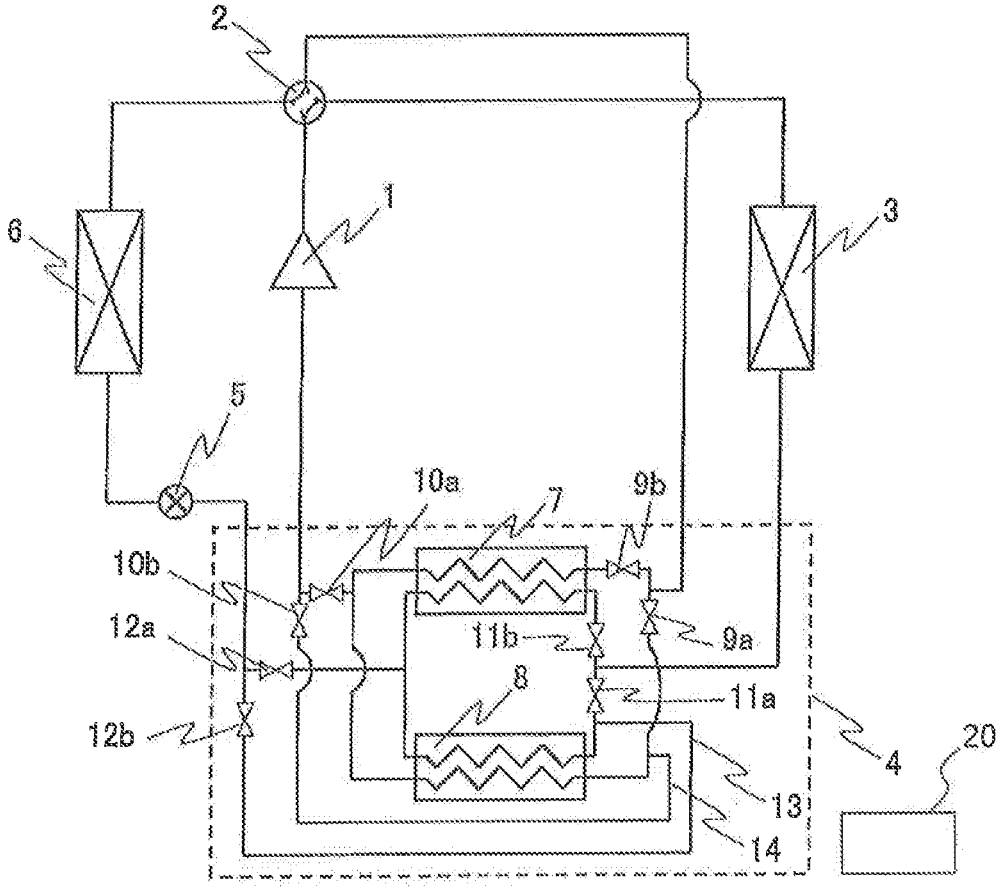
FIG. 12 is a diagram illustrating another exemplary configuration of the refrigeration cycle system according to Embodiment 1.

In the above description, the first high-pressure side three-way valve 11, which is a single component, includes the "first high-pressure side flow switching device" and the "fourth high-pressure side flow switching device" in the present invention, the second high-pressure side three-way valve 12, which is a single component, includes the "second high-pressure side flow switching device" and the "third high-pressure side flow switching device" in the present invention, the first low-pressure side three-way valve 9, which is a single component, includes the "first low-pressure side flow switching device" and the "fourth low-pressure side flow switching device" in the present invention, and the second low-pressure side three-way valve 10, which is a single component, includes the "second low-pressure side flow switching device" and the "third low-pressure side flow switching device" in the present invention. A two-way valve may be used instead of each three-way valve. FIG. 12 illustrates an exemplary configuration.

FIG. 12 is a diagram illustrating another exemplary configuration of the refrigeration cycle system according to Embodiment 1.

The internal heat exchanger 4 shown in FIG. 12 includes, instead of the first low-pressure side three-way valve 9, a first low-pressure side two-way valve 9*a* and a fourth low-pressure side two-way valve 9*b*. The internal heat exchanger 4 also includes, instead of the second low-pressure side three-way valve 10, a second low-pressure side two-way valve 10*a* and a third low-pressure side two-way valve 10*b*. The internal heat exchanger 4 moreover includes, instead of the first high-pressure side three-way valve 11, a first high-pressure side two-way valve 11*a* and a fourth high-pressure side two-way valve 11*b*. Again, the internal heat exchanger 4 includes, instead of the second high-pressure side three-way valve 12, a second high-pressure side two-way valve 12*a* and a third high-pressure side two-way valve 12*b*.

The first low-pressure side two-way valve 9*a* corresponds to the "first low-pressure side flow switching device" in the present invention. The fourth low-pressure side two-way valve 9*b* corresponds to the "fourth low-pressure side flow switching device" in the present invention. The second low-pressure side two-way valve 10*a* corresponds to the "second low-pressure side flow switching device" in the present invention. The third low-pressure side two-way valve 10*b* corresponds to the "third low-pressure side flow switching device" in the present invention. The first high-pressure side two-way valve 11*a* corresponds to the "first high-pressure side flow switching device" in the present invention. The fourth high-pressure side two-way valve 11*b* corresponds to the "fourth high-pressure side flow switching device" in the present invention. The second high-pressure side two-way valve 12*a* corresponds to the "second high-pressure side flow switching device" in the present invention. The third high-pressure side two-way valve 12*b* corresponds to the "third high-pressure side flow switching device" in the present invention.

The first low-pressure side two-way valve 9*a* is disposed between the inlet of the low-pressure side passage of the second internal heat exchanger 8 and a bifurcation at which a pipe connecting to the outlet of the heat source side heat exchanger 6 branches into a pipe connecting to the low-pressure side passage of the first internal heat exchanger 7 and a pipe connecting to the low-pressure side passage of the second internal heat exchanger 8.

The fourth low-pressure side two-way valve 9*b* is disposed between the inlet of the low-pressure side passage of the first internal heat exchanger 7 and the bifurcation at which the pipe connecting to the outlet of the heat source side heat exchanger 6 branches into the pipe connecting to the low-pressure side passage of the first internal heat exchanger 7 and the pipe connecting to the low-pressure side passage of the second internal heat exchanger 8.

The second low-pressure side two-way valve 10*a* is disposed between the compressor 1 and a junction at which a pipe connecting to the low-pressure side passage of the first internal heat exchanger 7 meets a pipe connecting to the low-pressure side passage of the second internal heat exchanger 8.

The third low-pressure side two-way valve 10*b* is provided to the second low-pressure side bypass pipe 14.

The first high-pressure side two-way valve 11*a* is disposed between the inlet of the high-pressure side passage of the second internal heat exchanger 8 and a bifurcation at which the pipe connecting to the outlet of the load side heat exchanger 3 branches into a pipe connecting to the high-pressure side passage of the first internal heat exchanger 7 and a pipe connecting to the high-pressure side passage of the second internal heat exchanger 8.

The fourth high-pressure side two-way valve 11*b* is disposed between the inlet of the high-pressure side passage of the first internal heat exchanger 7 and the bifurcation at which the pipe connecting to the outlet of the load side heat exchanger 3 branches into the pipe connecting to the high-pressure side passage of the first internal heat exchanger 7 and the pipe connecting to the high-pressure side passage of the second internal heat exchanger 8.

The second high-pressure side two-way valve 12*a* is disposed between the expansion valve 5 and a junction at which a pipe connecting to the high-pressure side passage of the first internal heat exchanger 7 meets a pipe connecting to the high-pressure side passage of the second internal heat exchanger 8.

The third high-pressure side two-way valve 12*b* is provided to the second high-pressure side bypass pipe 13.

In the parallel operation mode, the first high-pressure side two-way valve 11*a* and the fourth high-pressure side two-way valve 11*b* are set open. The second high-pressure side two-way valve 12*a* is set open and the third high-pressure side two-way valve 12*b* is set closed. The first low-pressure side two-way valve 9*a* and the fourth low-pressure side two-way valve 9*b* are set open. The second low-pressure side two-way valve 10*a* is set open and the third low-pressure side two-way valve 10*b* is set closed.

With this operation, the refrigerant, upon leaving the load side heat exchanger 3, parallelly flows through the high-pressure side passages of the first and second internal heat exchangers 7 and 8 and then flows into the expansion valve 5. The refrigerant, upon leaving the heat source side heat exchanger 6, flows through the low-pressure side passages of the first and second internal heat exchangers 7 and 8 and then flows into the compressor 1.

In the series operation mode, the first high-pressure side two-way valve 11*a* is set closed and the fourth high-pressure side two-way valve 11*b* is set open. The second high-pressure side two-way valve 12*a* is set closed and the third high-pressure side two-way valve 12*b* is set open. The first low-pressure side two-way valve 9*a* is set closed and the fourth low-pressure side two-way valve 9*b* is set open. The second low-pressure side two-way valve 10*a* is set closed and the third low-pressure side two-way valve 10*b* is set open.

With this operation, the refrigerant, upon leaving the load side heat exchanger 3, flows through the high-pressure side passage of the first internal heat exchanger 7, further flows through the high-pressure side passage of the second internal heat exchanger 8, and then flows through the second high-pressure side bypass pipe 13 into the expansion valve 5. The refrigerant, upon leaving the heat source side heat exchanger 6, flows through the low-pressure side passage of the first internal heat exchanger 7, further flows through the low-pressure side passage of the second internal heat exchanger 8, and then flows through the second low-pressure side bypass pipe 14 into the compressor 1.

In the bypass operation mode, the first high-pressure side two-way valve 11*a* is set open and the fourth high-pressure side two-way valve 11*b* is set closed. The second high-pressure side two-way valve 12*a* is set closed and the third high-pressure side two-way valve 12*b* is set open. The first low-pressure side two-way valve 9*a* is set open and the fourth low-pressure side two-way valve 9*b* is set closed. The second low-pressure side two-way valve 10*a* is set closed and the third low-pressure side two-way valve 10*b* is set open.

With this operation, the refrigerant, upon leaving the load side heat exchanger 3, flows through the second high-pressure side bypass pipe 13 into the expansion valve 5 without passing through the first and second internal heat exchangers 7 and 8. The refrigerant, upon leaving the heat source side heat exchanger 6, flows through the second low-pressure side bypass pipe 14 into the compressor 1 without passing through the first and second internal heat exchangers 7 and 8.

Although the high-pressure side passages and the low-pressure side passages of the first and second internal heat exchangers 7 and 8 are bypassed in the above-described bypass operation mode, the present invention is not limited to such an example.

The operation may be switched to a high-pressure bypass operation mode in which only the high-pressure side passages of the first and second internal heat exchangers 7 and 8 are bypassed. Instead, the operation may be switched to a low-pressure bypass operation mode in which only the low-pressure side passages of the first and second internal heat exchangers 7 and 8 are bypassed.

In the high-pressure bypass operation mode, the first high-pressure side two-way valve 11*a* is set open and the fourth high-pressure side two-way valve 11*b* is set closed. The second high-pressure side two-way valve 12*a* is set closed and the third high-pressure side two-way valve 12*b* is set open. Each of the first low-pressure side two-way valve 9*a*, the fourth low-pressure side two-way valve 9*b*, the second low-pressure side two-way valve 10*a*, and the third low-pressure side two-way valve 10*b* is set in the same manner as in either the series operation mode or the parallel operation mode.

With this operation, the refrigerant, upon leaving the load side heat exchanger 3, flows through the second high-pressure side bypass pipe 13 into the expansion valve 5 without passing through the high-pressure side passages of the first and second internal heat exchangers 7 and 8. The refrigerant, upon leaving the heat source side heat exchanger 6, passes through the low-pressure side passages of the first and second internal heat exchangers 7 and 8 and flows through the second low-pressure side bypass pipe 14 into the compressor 1.

In the low-pressure bypass operation mode, the first low-pressure side two-way valve 9*a* is set open and the fourth low-pressure side two-way valve 9*b* is set closed. The second low-pressure side two-way valve 10*a* is set closed and the third low-pressure side two-way valve 10*b* is set open. Each of the first high-pressure side two-way valve 11*a*, the fourth high-pressure side two-way valve 11*b*, the second high-pressure side two-way valve 12*a*, and the third high-pressure side two-way valve 12*b* is set in the same manner as in either the series operation mode or the parallel operation mode.

With this operation, the refrigerant, upon leaving the load side heat exchanger 3, passes through the high-pressure side passages of the first and second internal heat exchangers 7 and 8 and flows through the second high-pressure side bypass pipe 13 into the expansion valve 5. The refrigerant, upon leaving the heat source side heat exchanger 6, flows through the second low-pressure side bypass pipe 14 into the compressor 1 without passing through the low-pressure side passages of the first and second internal heat exchangers 7 and 8.

If, of the bypass operation mode, the high-pressure bypass operation mode, and the low-pressure bypass operation mode, only the high-pressure bypass operation mode is executed, the fourth low-pressure side two-way valve 9*b* may be omitted.

If, of the bypass operation mode, the high-pressure bypass operation mode, and the low-pressure bypass operation mode, only the low-pressure bypass operation mode is executed, the fourth high-pressure side two-way valve 11*b* may be omitted.

In the configuration shown in FIG. 12, the operation may be switched to a single-heat-exchanger operation mode in which heat is exchanged only in the first internal heat exchanger 7 of the first and second internal heat exchangers 7 and 8.

In the single-heat-exchanger operation mode, the first high-pressure side two-way valve 11*a* is set closed and the fourth high-pressure side two-way valve 11*b* is set open. The second high-pressure side two-way valve 12*a* is set open and the third high-pressure side two-way valve 12*b* is set closed. The first low-pressure side two-way valve 9*a* is set closed and the fourth low-pressure side two-way valve 9*b* is set open. The second low-pressure side two-way valve 10*a* is set open and the third low-pressure side two-way valve 10*b* is set closed.

With this operation, the refrigerant, upon leaving the load side heat exchanger 3, passes through the high-pressure side passage of the first internal heat exchanger 7 and then flows into the expansion means 5 without passing through the second internal heat exchanger 8. The refrigerant, upon leaving the heat source side heat exchanger 6, flows through the low-pressure side passage of the first internal heat exchanger 7 into the compressor 1 without passing through the second internal heat exchanger 8.

As described above, since heat is exchanged only in the first internal heat exchanger 7 of the first and second internal heat exchangers 7 and 8, the amount of heat exchange can be kept half that in the use of both the first and second internal heat exchangers 7 and 8. The single-heat-exchanger operation mode is effective when the amount of heat exchange is too large in the use of both the first and second internal heat exchangers 7 and (8) and is too small for zero in the bypass mode.

Figure 13:
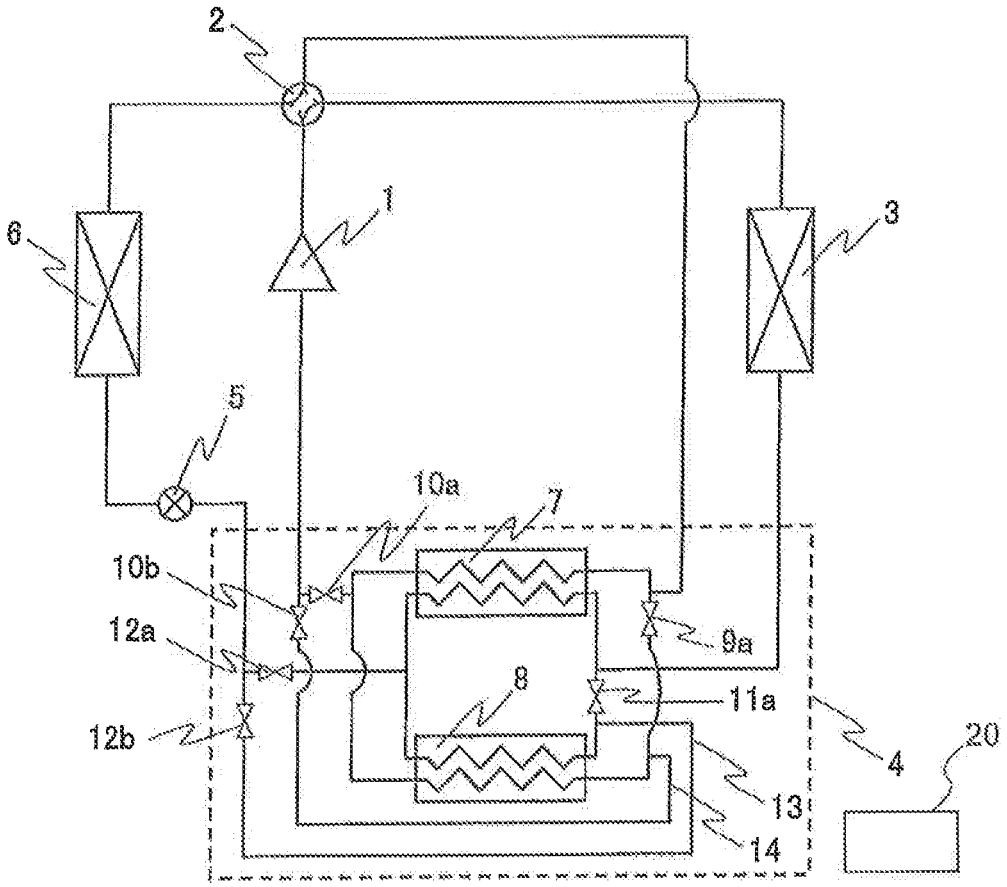
FIG. 13 is a diagram illustrating still another exemplary configuration of the refrigeration cycle system according to Embodiment 1.
Figure 14:
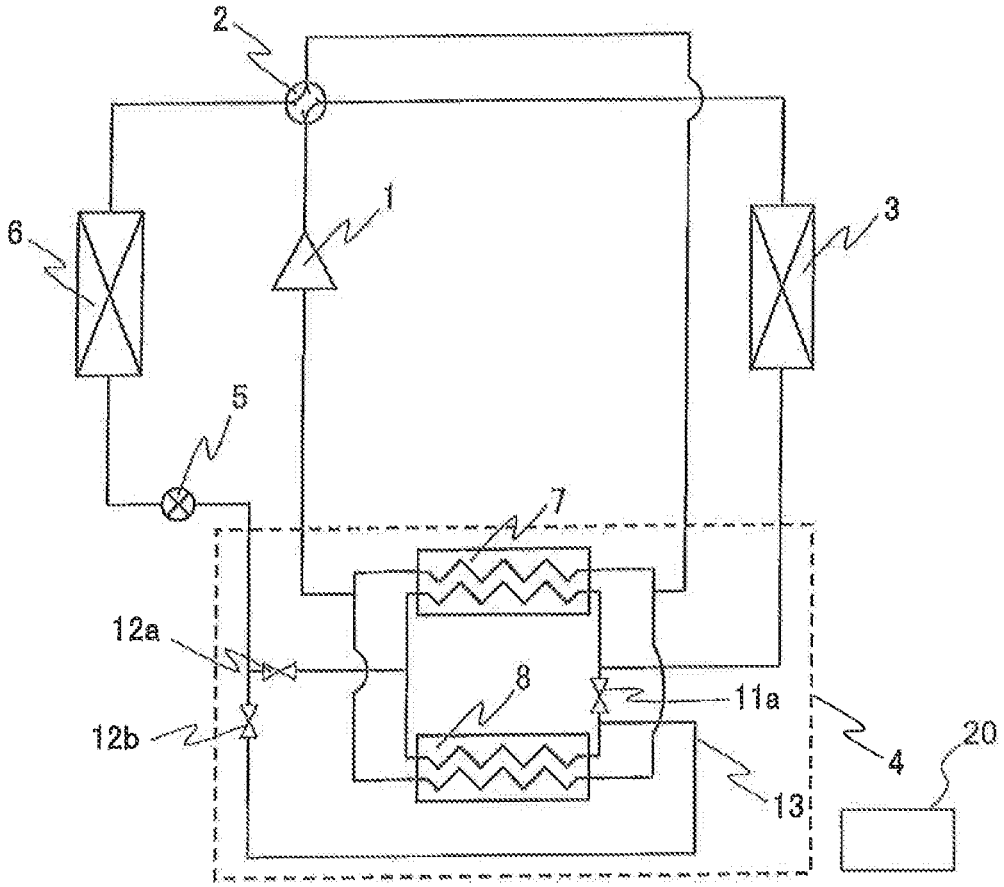
FIG. 14 is a diagram illustrating still another exemplary configuration of the refrigeration cycle system according to Embodiment 1.

In the above-described configuration shown in FIG. 12, two two-way valves are used instead of each three-way valve in FIG. 1. However, the present invention is not limited to such an example. FIGS. 13 and 14 illustrate exemplary configurations in which some of the two-way valves are omitted.

FIG. 13 is a diagram illustrating another exemplary configuration of the refrigeration cycle system according to Embodiment 1.

As illustrated in FIG. 13, the fourth low-pressure side two-way valve 9*b* and the fourth high-pressure side two-way valve 11*b* may be omitted from the above-described configuration shown in FIG. 12. In such a configuration as well, the operation can be switched between the parallel operation mode and the series operation mode.

In the parallel operation mode, the first high-pressure side two-way valve 11*a* is set open. The second high-pressure side two-way valve 12*a* is set open and the third high-pressure side two-way valve 12*b* is set closed. The first low-pressure side two-way valve 9*a* is set open. The second low-pressure side two-way valve 10*a* is set open and the third low-pressure side two-way valve 10*b* is set closed.

With this operation, the refrigerant, upon leaving the load side heat exchanger 3, parallelly flows through the high-pressure side passages of the first and second internal heat exchangers 7 and 8 and then flows into the expansion valve 5. The refrigerant, upon leaving the heat source side heat exchanger 6, parallelly flows through the low-pressure side passages of the first and second internal heat exchangers 7 and 8 and then flows into the compressor 1.

In the series operation mode, the first high-pressure side two-way valve 11*a* is set closed. The second high-pressure side two-way valve 12*a* is set closed and the third high-pressure side two-way valve 12*b* is set open. The first low-pressure side two-way valve 9*a* is set closed. The second low-pressure side two-way valve 10*a* is set closed and the third low-pressure side two-way valve 10*b* is set open.

With this operation, the refrigerant, upon leaving the load side heat exchanger 3, flows through the high-pressure side passage of the first internal heat exchanger 7, further flows through the high-pressure side passage of the second internal heat exchanger 8, and then flows through the second high-pressure side bypass pipe 13 into the expansion valve 5. The refrigerant, upon leaving the heat source side heat exchanger 6, flows through the low-pressure side passage of the first internal heat exchanger 7, further flows through the low-pressure side passage of the second internal heat exchanger 8, and then flows through the second low-pressure side bypass pipe 14 into the compressor 1.

As described above, in the configuration shown in FIG. 13, the flow of the refrigerant through the high-pressure side passage and the low-pressure side passage of the first internal heat exchanger 7 and that of the refrigerant through the high-pressure side passage and the low-pressure side passage of the second internal heat exchanger 8 are switched between a parallel flow pattern and a series flow pattern, so that the flow velocity of the refrigerant through the high-pressure side passages and the low-pressure side passages can be changed. Advantageously, the amount of heat exchange in each of the first and second internal heat exchangers 7 and 8 can be significantly controlled.

FIG. 14 is a diagram illustrating another exemplary configuration of the refrigeration cycle system according to Embodiment 1.

As illustrated in FIG. 14, the first low-pressure side two-way valve 9*a*, the fourth low-pressure side two-way valve 9*b*, the second low-pressure side two-way valve 10*a*, the third low-pressure side two-way valve 10*b*, the fourth high-pressure side two-way valve 11*b*, and the second low-pressure side bypass pipe 14 may be omitted from the above-described configuration shown in FIG. 12. In this configuration as well, the operation can be switched between the parallel operation mode and the series operation mode.

In the parallel operation mode, the first high-pressure side two-way valve 11*a* is set open, the second high-pressure side two-way valve 12*a* is set open, and the third high-pressure side two-way valve 12*b* is set closed.

With this operation, the refrigerant, upon leaving the load side heat exchanger 3, parallelly flows through the high-pressure side passages of the first and second internal heat exchangers 7 and 8 and then flows into the expansion valve 5.

In the series operation mode, the first high-pressure side two-way valve 11*a* is set closed, the second high-pressure side two-way valve 12*a* is set closed, and the third high-pressure side two-way valve 12*b* is set open.

With this operation, the refrigerant, upon leaving the load side heat exchanger 3, flows through the high-pressure side passage of the first internal heat exchanger 7, further flows through the high-pressure side passage of the second internal heat exchanger 8, and then flows through the second high-pressure side bypass pipe 13 into the expansion valve 5.

In each of the parallel operation mode and the series operation mode in the configuration shown in FIG. 14, the refrigerant, upon leaving the heat source side heat exchanger 6, flows through the low-pressure side passages of the first and second internal heat exchangers 7 and 8 and then flows into the compressor 1.

As described above, in the configuration shown in FIG. 14, the flow of the refrigerant through the high-pressure side passage of the first internal heat exchanger 7 and that of the refrigerant through the high-pressure side passage of the second internal heat exchanger 8 are switched between a parallel flow pattern and a series flow pattern, so that the flow velocity of the refrigerant can be changed. Thus, the amount of heat exchange in each of the first and second internal heat exchangers 7 and 8 can be controlled. Additionally, since the flow of the refrigerant through the low-pressure side passage of the first internal heat exchanger 7 and that of the refrigerant through the low-pressure side passage of the second internal heat exchanger 8 are always set in the parallel flow pattern, an increase in low-pressure side pressure loss can be suppressed, leading to increased efficiency.

Embodiment 2

Figure 11:
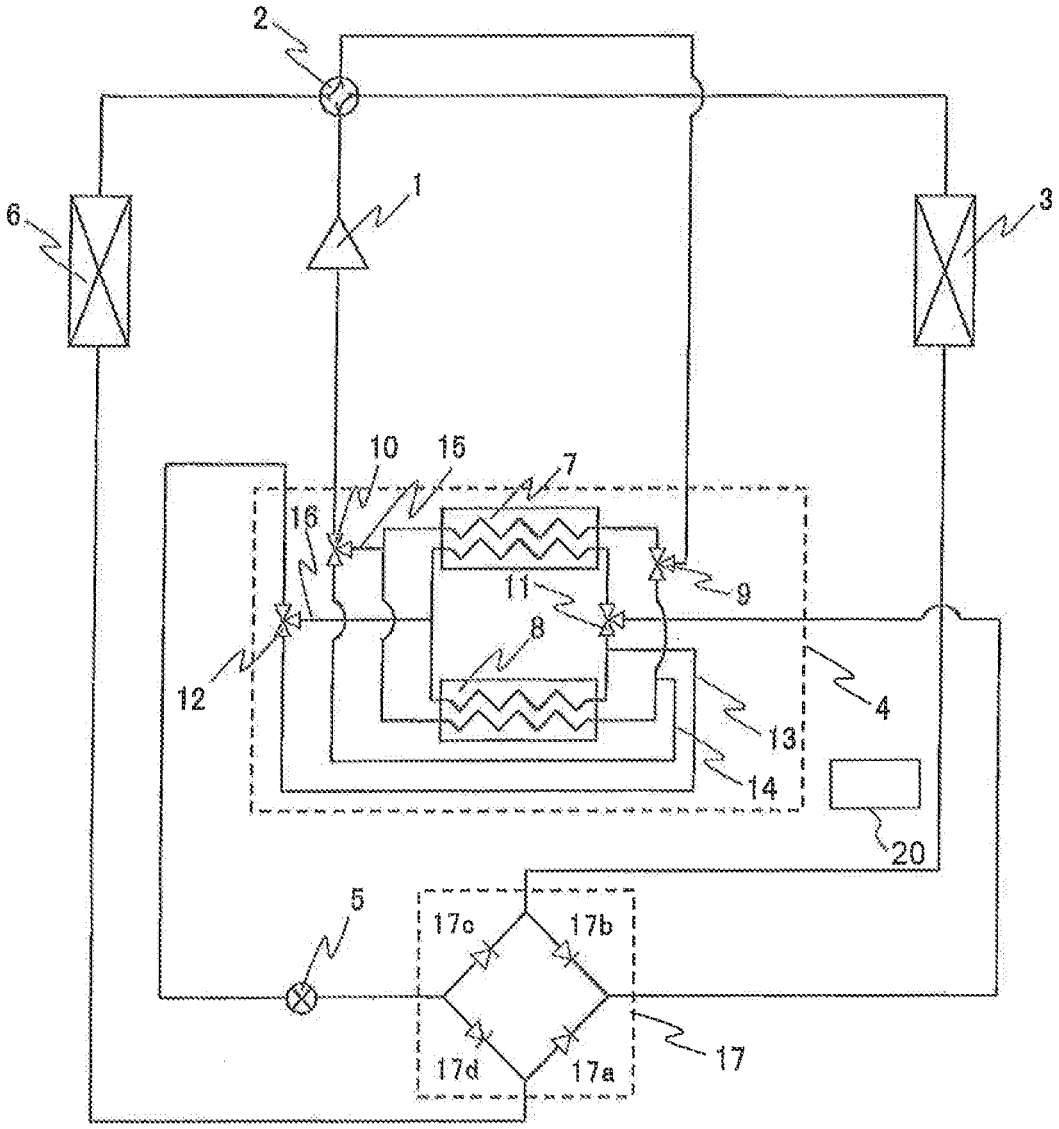
FIG. 11 is a diagram illustrating an exemplary configuration of a refrigeration cycle system according to Embodiment 2.

FIG. 11 is a diagram illustrating an exemplary configuration of a refrigeration cycle system according to Embodiment 2.

The refrigeration cycle system according to Embodiment 2 includes a bridge circuit 17, in addition to the components in Embodiment 1. The bridge circuit 17 is connected to the load side heat exchanger 3, the first high-pressure side three-way valve 11, the expansion valve 5, and the heat source side heat exchanger 6. The bridge circuit 17 includes check valves 17*a* to 17*d* which are connected in a bridge arrangement.

In the heating operation, the four-way valve 2 is switched so that the refrigerant discharged from the compressor 1 flows into the load side heat exchanger 3, and the refrigerant, upon leaving the heat source side heat exchanger 6, flows into the first low-pressure side three-way valve 9. This allows the load side heat exchanger 3 to function as a condenser and the heat source side heat exchanger 6 to function as an evaporator.

In this heating operation, the refrigerant, upon leaving the load side heat exchanger 3, flows through the check valve 17*b* of the bridge circuit 17 to the internal heat exchanger 4. The refrigerant, upon leaving the internal heat exchanger 4 and passing through the expansion valve 5, flows through the check valve 17*d* of the bridge circuit 17 to the heat source side heat exchanger 6.

In the cooling operation, the four-way valve 2 is switched so that the refrigerant discharged from the compressor 1 flows into the heat source side heat exchanger 6, and the refrigerant, upon leaving the load side heat exchanger 3, flows into the first low-pressure side three-way valve 9. This allows the load side heat exchanger 3 to function as an evaporator and also allows the heat source side heat exchanger 6 to function as a condenser.

In this cooling operation, the refrigerant, upon leaving the heat source side heat exchanger 6, flows through the check valve 17*a* of the bridge circuit 17 to the internal heat exchanger 4. The refrigerant, upon leaving the internal heat exchanger 4 and passing through the expansion valve 5, flows through the check valve 17*c* of the bridge circuit 17 to the load side heat exchanger 3.

According to Embodiment 2, in each of the heating operation and the cooling operation, the bridge circuit 17 allows the refrigerant, upon leaving the heat exchanger which is one of the load side heat exchanger 3 and the heat source side heat exchanger 6 and which functions as a condenser, to flow into the first high-pressure side three-way valve 11, and the refrigerant, upon leaving the expansion valve 5, to flow into the heat exchanger which is the other one of the load side heat exchanger 3 and the heat source side heat exchanger 6 and which functions as an evaporator. Consequently, the internal heat exchanger 4 functions in both the cooling operation and the heating operation. Advantageously, the cooling operation with high efficiency and enhanced reliability can be achieved.

The invention claimed is:

1. A refrigeration cycle system comprising:

a refrigerant circuit which includes a compressor, a load side heat exchanger, an internal heat exchanger, an expansion unit, and a heat source side heat exchanger connected by pipes, and through which a refrigerant circulates, the internal heat exchanger including a first internal heat exchanger in which the refrigerant, upon flowing through a high-pressure side passage, exchanges heat with the refrigerant, upon flowing through a low-pressure side passage, a second internal heat exchanger in which the refrigerant, upon flowing through a high-pressure side passage, exchanges heat with the refrigerant, upon flowing through a low-pressure side passage, a first high-pressure side flow switching device disposed between an outlet of the load side heat exchanger and one end of the high-pressure side passage of each of the first internal heat exchanger and the second internal heat exchanger, a second high-pressure side flow switching device disposed between the expansion unit and other end of the high-pressure side passage of each of the first internal heat exchanger and the second internal heat exchanger, a high-pressure side bypass pipe that branches off from a pipe connecting the first high-pressure side flow switching device and the high-pressure side passage of the second internal heat exchanger and that is connected between the second high-pressure side flow switching device and the expansion unit, a third high-pressure side flow switching device provided to the high-pressure side bypass pipe, and a controller that switches between a parallel operation mode in which the refrigerant, upon leaving the load side heat exchanger, parallelly flows through the high-pressure side passages of the first internal heat exchanger and the second internal heat exchanger and then flows into the expansion unit, and a series operation mode in which the refrigerant, upon leaving the load side heat exchanger, flows through the high-pressure side passage of the first internal heat exchanger, further flows through the high-pressure side passage of the second internal heat exchanger, and then flows through the high-pressure side bypass pipe into the expansion unit.

2. The refrigeration cycle system of claim 1, wherein the internal heat exchanger further includes:

a first low-pressure side flow switching device disposed between an outlet of the heat source side heat exchanger and one end of the low-pressure side passage of each of the first internal heat exchanger and the second internal heat exchanger;

a second low-pressure side flow switching device disposed between the compressor and other end of the low-pressure side passage of each of the first internal heat exchanger and the second internal heat exchanger;

a low-pressure side bypass pipe that branches off from a pipe connecting the first low-pressure side flow switching device and the low-pressure side passage of the second internal heat exchanger and connects to the compressor; and a third low-pressure side flow switching device provided to the low-pressure side bypass pipe, and wherein switching is allowed between a parallel operation mode in which the refrigerant, upon leaving the load side heat exchanger, parallelly flows through the high-pressure side passages of the first internal heat exchanger and the second internal heat exchanger and then flows into the expansion unit, and the refrigerant, upon leaving the heat source side heat exchanger, parallelly flows through the low-pressure side passages of the first internal heat exchanger and the second internal heat exchanger and then flows into the compressor, and a series operation mode in which the refrigerant, upon leaving the load side heat exchanger, flows through the high-pressure side passage of the first internal heat exchanger, further flows through the high-pressure side passage of the second internal heat exchanger, and then flows through the high-pressure side bypass pipe into the expansion unit, and the refrigerant, upon leaving the heat source side heat exchanger, flows through the low-pressure side passage of the first internal heat exchanger, further flows through the low-pressure side passage of the second internal heat exchanger, and then flows through the low-pressure side bypass pipe into the compressor.

3. The refrigeration cycle system of claim 1, wherein the internal heat exchanger further includes a fourth high-pressure side flow switching device disposed between an inlet of the high-pressure side passage of the first internal heat exchanger and a bifurcation at which a pipe connecting to the outlet of the load side heat exchanger branches into a pipe connecting to the high-pressure side passage of the first internal heat exchanger and a pipe connecting to the high-pressure side passage of the second internal heat exchanger, and wherein switching is allowed to a high-pressure bypass operation mode in which the refrigerant, upon leaving the load side heat exchanger, flows through the high-pressure side bypass pipe into the expansion unit without passing through the first internal heat exchanger and the second internal heat exchanger.

4. The refrigeration cycle system of claim 2, wherein the internal heat exchanger further includes a fourth low-pressure side flow switching device disposed between an inlet of the low-pressure side passage of the first internal heat exchanger and a bifurcation at which a pipe connecting to the outlet of the heat source side heat exchanger branches into a pipe connecting to the low-pressure side passage of the first internal heat exchanger and a pipe connecting to the low-pressure side passage of the second internal heat exchanger, and wherein switching is allowed to a low-pressure bypass operation mode in which the refrigerant, upon leaving the heat source side heat exchanger, flows through the low-pressure side bypass pipe into the compressor without passing through the first internal heat exchanger and the second internal heat exchanger.

5. The refrigeration cycle system of claim 2, wherein the internal heat exchanger further includes a fourth high-pressure side flow switching device disposed between an inlet of the high-pressure side passage of the first internal heat exchanger and a bifurcation at which a pipe connecting to the outlet of the load side heat exchanger branches into a pipe connecting to the high-pressure side passage of the first internal heat exchanger and a pipe connecting to the high-pressure side passage of the second internal heat exchanger, and a fourth low-pressure side flow switching device disposed between an inlet of the low-pressure side passage of the first internal heat exchanger and a bifurcation at which a pipe connecting to the outlet of the heat source side heat exchanger branches into a pipe connecting to the low-pressure side passage of the first internal heat exchanger and a pipe connecting to the low-pressure side passage of the second internal heat exchanger, and wherein switching is allowed to a bypass operation mode in which the refrigerant, upon leaving the load side heat exchanger, flows through the high-pressure side bypass pipe into the expansion unit without passing through the first internal heat exchanger and the second internal heat exchanger, and the refrigerant, upon leaving the heat source side heat exchanger, flows through the low-pressure side bypass pipe into the compressor without passing through the first internal heat exchanger and the second internal heat exchanger.

6. The refrigeration cycle system of claim 1, wherein the internal heat exchanger further includes a fourth high-pressure side flow switching device disposed between an inlet of the high-pressure side passage of the first internal heat exchanger and a bifurcation at which a pipe connecting to the outlet of the load side heat exchanger branches into a pipe connecting to the high-pressure side passage of the first internal heat exchanger and a pipe connecting to the high-pressure side passage of the second internal heat exchanger, and a fourth low-pressure side flow switching device disposed between an inlet of the low-pressure side passage of the first internal heat exchanger and a bifurcation at which a pipe connecting to the outlet of the heat source side heat exchanger branches into a pipe connecting to the low-pressure side passage of the first internal heat exchanger and a pipe connecting to the low-pressure side passage of the second internal heat exchanger, and wherein switching is allowed to a single-heat-exchanger operation mode in which the refrigerant, upon leaving the load side heat exchanger, flows through the high-pressure side passage of the first internal heat exchanger and then flows into the expansion unit without passing through the second internal heat exchanger, and the refrigerant, upon leaving the heat source side heat exchanger, flows through the low-pressure side passage of the first internal heat exchanger and then flows into the compressor without passing through the second internal heat exchanger.

7. The refrigeration cycle system of claim 5, wherein the first low-pressure side flow switching device and the fourth low-pressure side flow switching device are formed as a single three-way valve, wherein the second low-pressure side flow switching device and the third low-pressure side flow switching device are formed as a single three-way valve, wherein the first high-pressure side flow switching device and the fourth high-pressure side flow switching device are formed as a single three-way valve, and wherein the second high-pressure side flow switching device and the third high-pressure side flow switching device are formed as a single three-way valve.

8. The refrigeration cycle system of claim 1, wherein when occurrence of liquid back to the compressor is detected in the parallel operation mode, switching is made to the series operation mode.

9. The refrigeration cycle system of claim 1, wherein when an operation of the refrigeration cycle system is started, or when a defrosting operation is ended, switching is made to the series operation mode, and wherein when a predetermined time has elapsed after the series operation mode is enabled, or when a degree of superheat or a temperature of the refrigerant at a discharge outlet of the compressor takes a value not less than a predetermined value, switching is made to the parallel operation mode.

10. The refrigeration cycle system of claim 2, wherein the first high-pressure side flow switching device, the second high-pressure side flow switching device, the first low-pressure side flow switching device, and the second low-pressure side flow switching device switch a flow path of the refrigerant so that switching is allowed to a bypass operation mode in which the refrigerant, upon leaving the load side heat exchanger, flows through the high-pressure side bypass pipe into the expansion unit without passing through the first internal heat exchanger and the second internal heat exchanger, and the refrigerant, upon leaving the heat source side heat exchanger, flows through the low-pressure side bypass pipe into the compressor without passing through the first internal heat exchanger and the second internal heat exchanger.

11. The refrigeration cycle system of claim 10, wherein when a temperature of the refrigerant at a discharge outlet of the compressor takes a value not less than a predetermined value, switching is made to the bypass operation mode, and wherein when the temperature of the refrigerant at the discharge outlet of the compressor takes a value below the predetermined value, switching is made to the parallel operation mode.

12. The refrigeration cycle system of claim 1, wherein a stream of the refrigerant flowing through the high-pressure side passage of the first internal heat exchanger, and a stream of the refrigerant flowing through the low-pressure side passage thereof flow in counter flow, and wherein a stream of the refrigerant flowing through the high-pressure side passage of the second internal heat exchanger, and a stream of the refrigerant flowing through the low-pressure side passage thereof flow in counter flow.

13. The refrigeration cycle system of claim 2, further comprising:

a four-way valve that switches a flow path of the refrigerant discharged from the compressor between a flow path leading to the load side heat exchanger and a flow path leading to the heat source side heat exchanger, and switches a flow path of the refrigerant flowing into the first low-pressure side flow switching device between a flow path leading from the heat source side heat exchanger and a flow path leading from the load side heat exchanger; and a bridge circuit connected to the load side heat exchanger, the first high-pressure side flow switching device, the expansion unit, and the heat source side heat exchanger, wherein the bridge circuit allows the refrigerant, upon leaving the heat exchanger which is one of the load side heat exchanger and the heat source side heat exchanger and which functions as a condenser, to flow into the first high-pressure side flow switching device, and the refrigerant, upon leaving the expansion unit, to flow into the heat exchanger which is the other one of the load side heat exchanger and the heat source side heat exchanger and which functions as an evaporator.

14. The refrigeration cycle system of claim 1, wherein the second high-pressure side flow switching device and the third high-pressure side flow switching device are formed integrally as a single three-way valve.

15. The refrigeration cycle system of claim 2, wherein the second low-pressure side flow switching device and the third low-pressure side flow switching device are formed integrally as a single three-way valve.

16. The refrigeration cycle system of claim 3, wherein the first high-pressure side flow switching device and the fourth high-pressure side flow switching device are formed integrally as a single three-way valve.

17. The refrigeration cycle system of claim 4, wherein the first low-pressure side flow switching device and the fourth low-pressure side flow switching device are formed integrally as a single three-way valve.

* * * * *